US005844402A

United States Patent [19]

Peschel et al.

[11] Patent Number: 5,844,402

[45] Date of Patent: Dec. 1, 1998

[54] IN-LINE BUCK/BOOST VOLTAGE-REGULATION SYSTEMS AND APPARATUS

[75] Inventors: Stanley G. Peschel, Millerton; Arthur Molden, Carmel; Oscar Tonello, Pawling, all of N.Y.

[73] Assignee: Hubbell Incorporated, Orange, Conn.

[21] Appl. No.: 671,351

[22] Filed: Jun. 27, 1996

[51] Int. Cl.[6] ..... G05F 1/253

[52] U.S. Cl. ..... 323/262

[58] Field of Search ..... 323/262, 263, 323/259, 255, 251

[56] References Cited

U.S. PATENT DOCUMENTS

| | | | |
|---|---|---|---|
| 3,611,117 | 10/1971 | Schneider | 323/262 |
| 4,178,539 | 12/1979 | Crapo | 323/262 |
| 4,189,672 | 2/1980 | Peschel | 323/43.5 R |
| 4,330,818 | 5/1982 | Peschel | 363/126 |
| 4,517,439 | 5/1985 | Colley | 219/130.33 |

FOREIGN PATENT DOCUMENTS

| | | | |
|---|---|---|---|
| 0440654 | 1/1975 | U.S.S.R. | 323/262 |
| 0989541 | 1/1983 | U.S.S.R. | 323/262 |

OTHER PUBLICATIONS

Generation, Transmission And Utilization of Electrical Power, by A. T. Starr, Sir Isaac Pitman & Sons Ltd., London, Fourth Edition reprinted 1965 (first published 1937), pp. 184–187.

Standard Handbook For Electrical Engineers, Donald G. Fink, Editor in Chief, H. Wayne Beaty, Associate Editor, McGraw–Hill Book Company, Eleventh Edition Copyright 1978, pp. 10–92—10–109.

*Primary Examiner*—Adolf Berhane

*Attorney, Agent, or Firm*—Jerry M. Presson; William C. Roch; G. Kendall Parmelee

[57] ABSTRACT

An in-line buck/boost voltage/regulating apparatus and system for delivering AC electrical power of regulated voltage from an output terminal of a main winding to an electrical load. The apparatus has an input terminal for connection to an AC power supply and comprises first, second and third ferromagnetic transformer cores having first, second and third cross-sectional areas, respectively; and these cross-sectional areas have relative sizes of X square units, Y square units and Z square units, respectively. There are first, second and third regulator windings respectively mounted on the first, second and third cores, and electromagnetically coupled with their respective cores. The first, second and third windings have first, second and third numbers of turns, respectively. Switching elements selectively connect the first, second and/or third windings across the AC supply and selectively short-circuit any of the first, second and/or third windings which are not connected across the AC supply. The main winding is mounted on the first, second and third cores and electromagnetically couples with all of them. The main winding has an input terminal for connection to the AC supply and has its output terminal for delivering AC power of regulated voltage from the output terminal to an electrical load.

20 Claims, 9 Drawing Sheets

| ITEM | DESCRIPTION |
|---|---|
| R | TRANSITION RESISTOR |
| S1 | TRANSITION SWITCH |
| S2 | WINDING NEUTRALIZING SWITCH |
| S3 | WINDING SELECTION SWITCH |
| S4,S7 | "BUCK" WINDING SELECTION |
| S5,S6 | "BOOST" WINDING SELECTION |

| ITEM | DESCRIPTION |
|---|---|
| WINDING 1 | 1% WINDING |
| WINDING 2 | 2% WINDING |
| WINDING 3 | 4% WINDING |
| WINDING 4 | 8% WINDING |

| ITEM | DESCRIPTION |
|---|---|
| WINDING 1 | 1% WINDING |
| WINDING 2 | 2% WINDING |
| WINDING 3 | 4% WINDING |
| WINDING 4 | 8% WINDING |

| ITEM | DESCRIPTION |
|---|---|
| R | TRANSITION RESISTOR |
| S1 | TRANSITION SWITCH |
| S2 | WINDING NEUTRALIZING SWITCH |
| S3 | WINDING SELECTION SWITCH |
| S4,S7 | "BUCK" WINDING SELECTION |
| S5,S6 | "BOOST" WINDING SELECTION |

IN-LINE BUCK/BOOST VOLTAGE-REGULATION SYSTEMS AND APPARATUS

FIELD OF THE INVENTION

The present invention is in the field of voltage regulation of electrical power to be supplied to a load and more particularly relates to in-line, buck/boost voltage-regulation systems and apparatus for voltage regulation of single-phase electrical power and of three-phase electrical power.

BACKGROUND

Prior voltage-regulation systems and apparatus, insofar as we are aware, have required that the whole of the electrical power being supplied to a load and whose voltage is being regulated must be handled by the regulation equipment. In other words, such prior voltage-regulation systems and apparatus have been required to handle the "whole bulk" of the electrical power being supplied to the load.

Therefore, prior voltage-reduction equipment usually has been designed to be sufficiently large with sufficient electrical power capability for handling the full amount of kilovolt amperes (KVA) desired to be available for a rated KVA load whose voltage is intended to be regulated. As a result of the need to handle the whole bulk of the electrical power, such prior voltage-regulation installations were relatively large and expensive and involved considerable electrical losses in proportion to the amount of power and percentage range of voltage regulation being provided.

In addition, many prior voltage-regulation systems and apparatus have involved mechanically movable components, for example such as mechanically shifting positions of electromagnetic members for changing effective coupling between primary and secondary windings, or such as movable electrical contacts for changing the ratio of primary-to-secondary turns. Such prior voltage-regulation equipment involving movable components required mechanical drives with their attendant complexities and costs, additional size, weight and which entailed maintenance and lubrication requirements for relatively heavy moving parts.

SUMMARY

Among the advantages of the in-line buck/boost voltage-regulation systems and apparatus embodying the present invention are those arising from the fact that they handle only a portion of the bulk power whose voltage is being controlled by the regulation system or apparatus. For example a system and apparatus embodying the invention and rated for providing voltage regulation over a range of plus or minus 15% of rated output voltage will be bucking or boosting the voltage of only about 15% of the rated KVA output power, while the vast majority of the output power flows through the system and apparatus via a relatively high-conductivity main winding connection path from the power source directly to the load. This high-conductivity connection path includes relatively few turns of an electrical main winding. At periods of time when no voltage regulation is occurring because the AC supply voltage happens to be equal to the desired output level, no bucking nor boosting is applied, and the whole of the power flows through the system and apparatus without any electrical power being handled by the system and apparatus except for incidental hysteresis, eddy current and resistance losses. Consequently, the present systems and apparatus are proportionately smaller and more economical and involve smaller electrical losses in proportion to the quantity of output electrical power and the range of voltage being regulated.

In accordance with the present invention in one of its embodiments there is provided in-line buck/boost voltage-regulating apparatus for delivering AC electrical power of regulated voltage from an output terminal to an electrical load, wherein the apparatus has an input terminal for connection to an AC supply of electrical power and wherein this apparatus comprises: at least first, second and third ferromagnetic transformer cores having first, second and third cross-sectional areas, respectively; and these cross-sectional areas have relative sizes of X square units, Y square units and Z square units, respectively. There are first, second and third regulator windings respectively mounted on the first, second and third cores, and electromagnetically coupled with their own cores. The first, second and third regulator windings have first, second and third numbers of turns, respectively, wherein the numbers have relative values of N1, N2 and N3, respectively, where N1, N2 and N3 are predetermined numbers. This apparatus includes switching means for selectively connecting the first, second and/or third regulator windings across the AC supply and for selectively short-circuiting any of the first, second and/or third regulator windings which are "not active", i.e., which are not connected across the AC supply. There is a main winding mounted on the first, second and third cores and electromagnetically coupling with all of them. The main winding has an input terminal for connection to the AC supply of electrical power and has an output terminal for delivering AC power of regulated voltage from this output terminal to an electrical load.

In accord with the present invention in one advantageous aspect, the switching means selectively connect the first, second and/or third regulator windings across the AC supply in bucking or boosting voltage relationship relative to the main winding for reducing or increasing the voltage delivered by the output terminal of the main winding.

In accord with the present invention in another advantageous aspect, there are first, second and third resistance means normally not connected in circuit across any active ones of the first, second and third regulator windings. These resistance means momentarily provide a transition-current-flow path in circuit across the first, second and third regulator windings, respectively, during selective switching of the respective regulator windings from being short-circuited to being connected across the AC supply and also momentarily provide such a transition-current-flow path during selective reverse switching of these respective windings from being connected across the AC supply to being short-circuited.

In accord with the present invention in another of its advantageous aspects, there are provided control means responsive to the instants at which the AC voltage crosses the zero-current axis at each switching means for the purpose of selectively actuating the switching means only during such instants as are advantageous for minimizing electrical stresses in the switching means during switching action and for minimizing electromagnetic interference.

In apparatus embodying the present invention there is a main winding having an input terminal for connection in circuit with an AC source of electrical power and having an output terminal for connection in circuit with an electrical load for connecting the main winding in series relationship between the AC source and the electrical load. The apparatus includes at least first, second and third ferromagnetic transformer cores having first, second and third cross-sectional areas with relative sizes of X square units, Y square units and Z square units. The main winding is coupled to all of these cores. The apparatus also includes first, second and third regulator windings electromagnetically coupled to their own cores, and these regulator windings have first, second and third numbers of turns, respectively, with relative values of N1, N2 and N3, respectively, where N1, N2 and N3 are predetermined numbers. Switching means selectively connect the first, second and/or third regulator windings to the AC source of electrical power and the switching means selectively short-circuit any of the first, second and/or third regulator windings which are not connected to the AC source.

In summary, the relative numbers of turns in the first, second and third regulator windings are inversely proportional to the ratios of the cross-sectional areas of the respective individual ferromagnetic cores to which the regulator windings are coupled electromagnetically.

As another example, there may be four regulator windings providing 1%, 2%, 4% and 8% voltage regulation effects. By switching one or more of them into boosting relationship, voltage regulation over a range of plus fifteen percent may be provided with incremental steps of one percent over this plus fifteen percent range. Conversely, by switching one or more of them into bucking relationship, voltage regulation over a range of minus fifteen percent may be provided with incremental steps of one percent over this minus fifteen percent range. In this 1%, 2%, 4% and 8% example, all windings which are active at any moment of time are operated in the same mode, that is, all windings which are active are operated in their boost mode or all windings which are active are operated in their buck mode. If the input voltage happens to be at the desired level, then neither boost nor buck occurs.

In a 1%, 2% and 7% apparatus, the switching means may simultaneously connect selected regulator windings across the AC source in the same mode or in opposite modes so as to provide voltage regulation over a range of plus or minus ten percent with incremental steps of one percent over this full range.

Other advantageous percentage distributions among respective regulator windings are described such as 2%, 4% and 14% for voltage regulation over a range of plus or minus twenty percent in incremental steps of 2% with active windings operable simultaneously in opposite modes, and such as 3%, 6% and 12% for three-phase voltage regulation over plus or minus twenty-one percent in steps of 3% with active windings all operating in the same mode. Other examples are: 1%, 2%, 4%, 8% and 16% for voltage regulation over a range of plus or minus thirty-one percent in steps of 1% with active windings all operating in the same mode, and such as 1%, 2%, 7% and 21% for voltage regulation over a range of plus or minus thirty-one percent in steps of 1% with active windings operable simultaneously in opposite modes.

BRIEF DESCRIPTION OF THE DRAWINGS

The invention, together with further objects, features, advantages and aspects thereof, will be more clearly understood from the following detailed description considered in conjunction with the accompanying drawings which are not drawn to scale with the emphasis instead being placed upon clearly illustrating the principles of the invention. Like reference numerals indicate like elements or like components throughout the different views.

The accompanying drawings, which are incorporated in and constitute a part of the specification, illustrate presently preferred embodiments of the invention and, together with the general description set forth above and the detailed description of the preferred embodiments set forth below, serve to explain the principles of the invention. In these drawings.

DETAILED DESCRIPTION OF PREFERRED EMBODIMENTS

Figure 1:
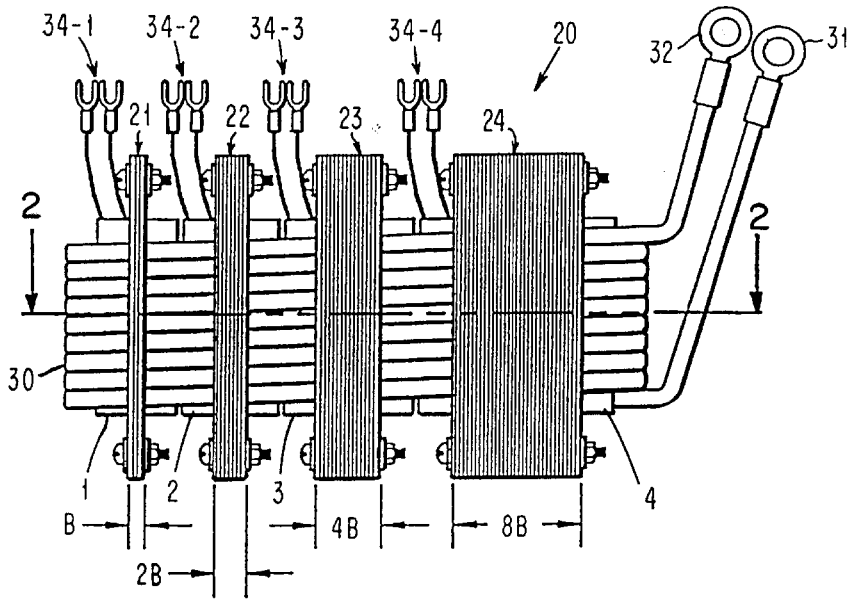
FIG. 1 is a top plan view of in-line, buck/boost, voltage-regulation apparatus having four ferromagnetic transformer cores. These four cores as shown have respective cross-sectional areas whose relative sizes, i.e., relative "builds", are in a ratio of 1 to 2 to 4 to 8.
Figure 2:
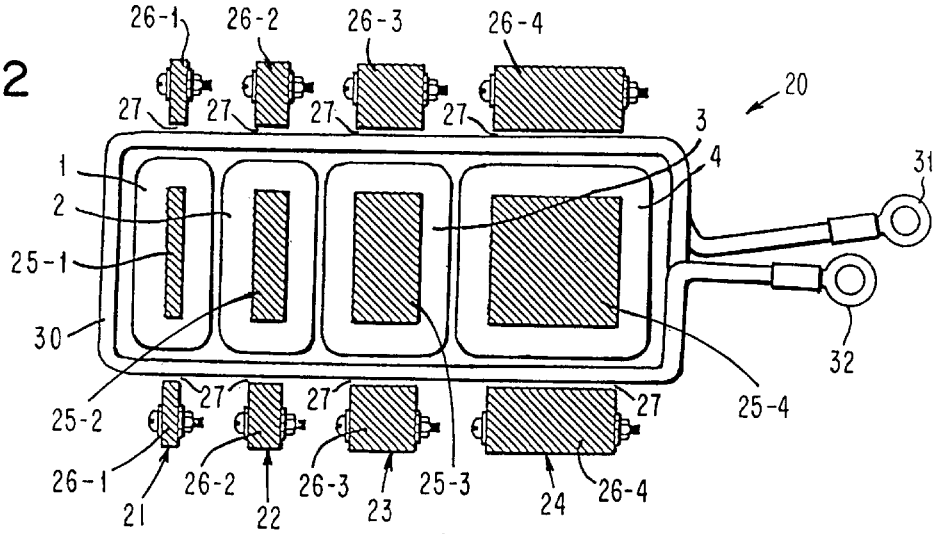
FIG. 2 is a plan cross-sectional view taken along the plane 2—2 through the voltage-regulation transformer apparatus of FIG. 1.
Figure 3:
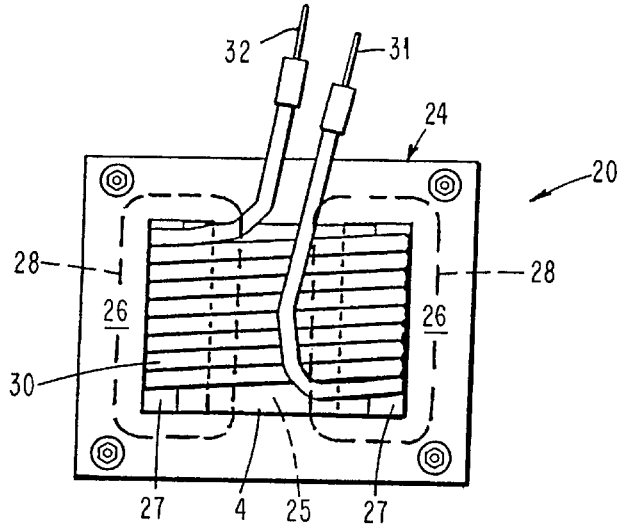
FIG. 3 is an end elevational view as seen looking from the right in FIG. 1.

In FIGS. 1, 2 and 3 is shown a transformer embodying the present invention generally indicated at 20, having first, second, third and fourth ferromagnetic cores 21, 22, 23 and 24 built up from laminations of transformer steel (also called "transformer iron"). As seen in FIGS. 2 and 3, each of these cores has a central leg 25 and a pair of outer core legs 26 with a pair of winding windows 27 of substantially identical shape. As shown in FIG. 2, the respective pairs of outer legs 26-1, 26-2, 26-3 and 26-4 in each respective core 21, 22, 23 and 24 are of substantially equal cross-sectional area, and the cross-sectional area of the respective central leg 25-1, 25-2, 25-3 or 25-4 is substantially equal to twice the cross-sectional area of the respective outer leg 26-1, 26-2, 26-3 or 26-4.

The magnetic flux in each of these four cores 21, 22, 23 and 24 generally follows a pair of oval paths encircling the respective winding window 27 as is shown by two dashed ovals 28 in FIG. 3. In each core approximately twice as much flux passes through a central leg 25 compared with the amount of flux passing through either outer leg 26. Therefore, relative to flux density involved, and neglecting minor fringing flux effects, the central leg of each core 21, 22, 23 and 24 experiences substantially the same flux density as either outer leg of the same core. Thus, the amount of magnetic flux and the flux density in the central leg of each core is characteristic of that particular core as a whole.

In this specification, references will be made to the cross-sectional areas of the respective cores 21, 22, 23 and 24. It is to be understood that such references are being made to the central leg 25 of each core, since magnetic flux conditions in the central leg are characteristic of such conditions throughout that respective core as a whole. Also a clearer explanation is provided by talking about the cross-sectional areas of the central core legs, which may be considered as main components of each core, rather than talking about the cross-sectional areas of the respective outer legs, which may be considered to be half-components of each core. Moreover, a more straightforward electromagnetic relationship may be envisioned between the central core legs and the respective windings encircling these central core legs.

For reasons which will be explained in detail later, the "build" shown by dimension arrows "B" in FIG. 1, i.e., the overall stack thicknesses, of the assembled laminations in cores 21, 22, 23 and 24 are respectively 1B, 2B, 4B and 8B. Thus, the relative sizes of the cross-sectional areas of these four cores are in the ratio of 1 to 2 to 4 to 8.

The built-up laminations in each core 21, 22, 23 and 24 are secured together by suitable fastening means as known in the art to form ferromagnetic transformer cores structures wherein eddy current losses are minimized appropriately.

Instead of fabricating the cores from laminations of transformer iron, these cores may be fabricated from other ferromagnetic material, for example such as ferrites. It is important that all of the cores be made of the same ferromagnetic material so that they will exhibit substantially identical magnetic characteristics, such as permeability, coercivity and hysteresis and substantially identical electrical characteristics, such as specific resistivity against eddy current losses.

Mounted on and encircling the respective four central core legs 25-1, 25-2, 25-3 and 25-4 are four regulator windings 1, 2, 3 and 4. As seen in FIG. 2, each regulator winding passes through both winding windows of its respective core 21, 22, 23, or 24. Since each regulator winding encircles only the central leg of its respective core, each winding 1, 2, 3 or 4 is electromagnetically coupled essentially solely to its own individual core 21, 22, 23 or 24, i.e., neglecting any incidental coupling caused by stray electromagnetic flux.

In order to provide predetermined incremental adjustments of output voltage, as explained in detail later, while also creating substantially identical flux conditions in all four cores 21, 22, 23 and 24, the relative numbers of turns in the respective regulator windings 1, 2, 3 and 4 are inversely proportional to the ratios of the cross-sectional areas of the respective cores 21, 22, 23 or 24 to which the respective regulator winding is coupled electromagnetically.

Encircling all four of the central core legs 25-1, 25-2, 25-3 and 25-4 and passing through all of the winding windows 27 is a main winding 30 having input and output terminals 31 and 32. Since this main winding encircles all of the central legs, it is coupled electromagnetically to all four cores 21, 22, 23 and 24.

In this voltage-regulation transformer 20, the following parameters apply. The cross-sectional areas of the cores 21, 22, 23 and 24 are in a ratio of 1 to 2 to 4 to 8, and the relative numbers of turns in the respective regulator windings 1, 2, 3 and 4 are in a ratio of 8 to 4 to 2 to 1, i.e., the numbers of turns are inversely proportional to the relative sizes of the cross-sectional areas of the respective cores 21, 22, 23 and 24 to which these regulator windings are electromagnetically coupled. The apparatus 20 is arranged to have a KVA rating of 12 KVA comprising 100 amperes at 120 volts and 60 Hertz. The desired AC output voltage to be provided from output terminal 32 relative to the common or neutral or "ground" is 120 volts. When the AC input voltage at input terminal 31 relative to ground happens to be 120 volts (equal to the desired output of 120 volts), then none of the regulator windings 1, 2, 3 nor 4 is "active", i.e., none is in regulating relationship with respect to the output voltage.

Figure 4:
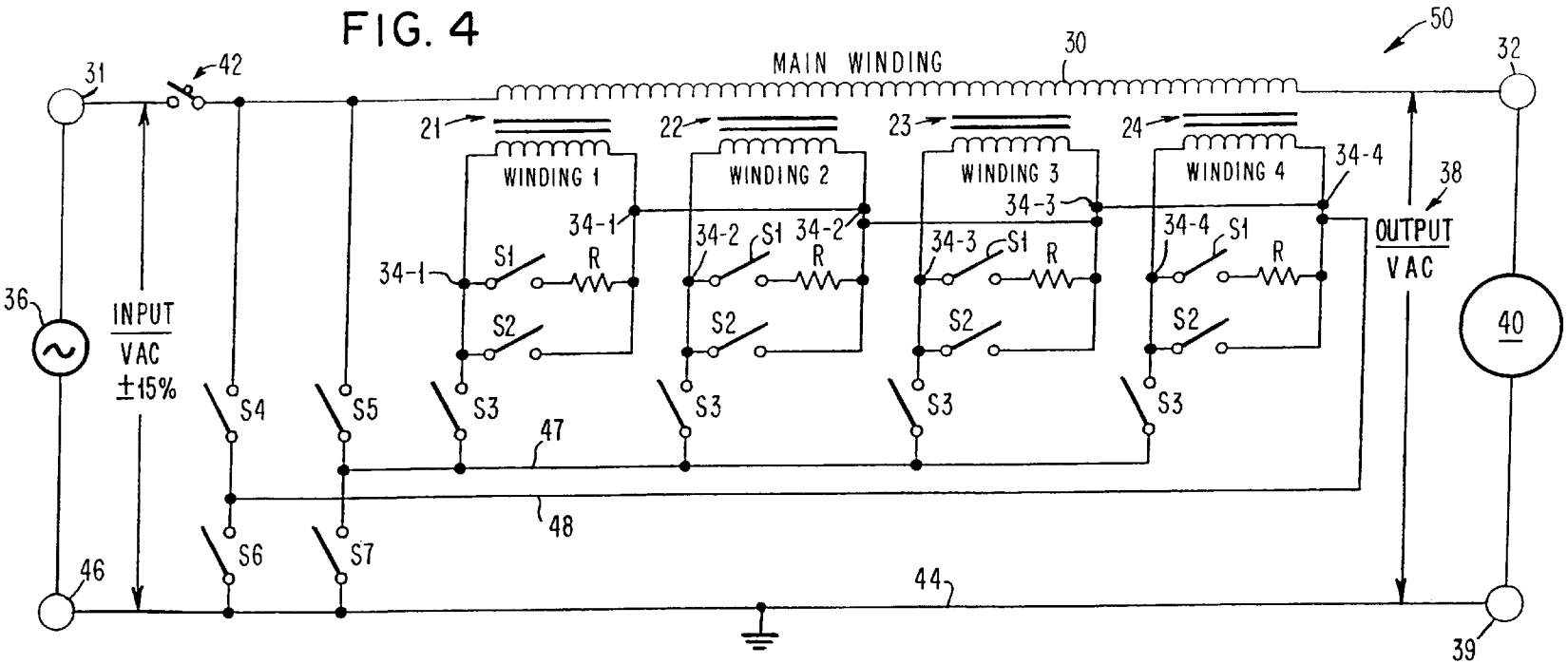
FIG. 4 is a schematic circuit diagram showing the in-line buck/boost, voltage-regulation transformer apparatus of FIGS. 1, 2 and 3 incorporated in a voltage-regulation system embodying the invention.

The "electrical center" is defined as the condition wherein the input voltage is 120 volts and the output voltage at 120 volts is equal to the input voltage, and no regulator winding is active. These regulator windings have pairs of regulator terminals 34-1, 34-2, 34-3 and 34-4 (FIG. 1). With reference to FIG. 4, these pairs of terminals can be switched into circuit in connection with an AC supply 36 in a bucking or boosting mode relative to the voltage provided by the main winding 30 at its output terminal 32.

The voltage-regulation apparatus 20 is arranged to have an output voltage resolution of 1% and to have an operating range of plus or minus 15% of the 120 volt electrical center condition. Thus, the maximum input voltage from the AC power source 36 at which the apparatus 20 can maintain its rated output 38 at 120 volts is that input voltage at which 120 volts output is equal to 85% of the input voltage. Conversely, the minimum input voltage from the AC supply 36 at which the apparatus 20 can maintain its output at 120 volts is that input voltage at which 120 volts output is equal to 115% of the input voltage.

Consequently, the operating (input) range over which this voltage-regulation apparatus can maintain the specified output voltage of 120 volts is expressed:

$$(1)\ 1/(1+R) \text{ to } 1/(1-R)$$

where R=Range as a decimal.

In this example wherein R=0.15, the voltage-regulation apparatus will maintain the specified rated output voltage with an input voltage of from 87% to 118% of the output value of 120 volts, namely with an input voltage in a range from about 104.4 volts to about 141.6 volts. A more usual way to specify this operating capability is as a −13% to +18% operating capability relative to the "electrical center" input voltage of 120 volts.

By virtue of using regulator windings having relative numbers of turns in the ratio of 1 to 2 to 4 to 8, the polarity ("sense") of these windings (whether they are acting in their bucking mode or in their boosting mode) need only be changed when traversing the "electrical center" condition defined above. The desired 1% resolution is provided over the desired plus or minus 15% range R by employing the respective regulator windings as set forth below.

| Regulating Action Being Provided: | | Regulator winding(s) Involved: |
|---|---|---|
| 0% | 0 | No active regulator winding |
| ±1% | 1 | 1% winding |
| ±2% | 2 | 2% winding |
| ±3% | 2 and 1 | 2% and 1% windings |
| ±4% | 3 | 4% winding |
| ±5% | 3 and 1 | 4% and 1% windings |
| | ±6% | 3 and 2 4% and 2% windings |
| ±7% | 3 and 2 and 1 | 4%, 2% and 1% windings |
| ±8% | 4 | 8% winding |
| ±9% | 4 and 1 | 8% and 1% windings |
| ±10% | 4 and 2 | 8% and 2% windings |

-continued

| Regulating Action Being Provided: | Regulator winding(s) Involved: | |
|---|---|---|
| ±11% | 4 and 2 and 1 | 8%, 2% and 1% windings |
| ±12% | 4 and 3 | 8% and 4% windings |
| ±13% | 4 and 3 and 1 | 8%, 4% and 1% windings |
| ±14% | 4 and 3 and 2 | 8%, 4% and 2% windings |
| ±15% | 4 and 3 and 2 and 1 | 8%, 4%, 2% and 1% windings |

In accord with LENZ'S LAW (and ignoring any magnetizing current), the fact that the main winding 30 is electromagnetically coupled to each of the four ferromagnetic cores 21, 22, 23 and 24 causes the Ampere-Turns Product ("AT") for each of these four cores to be equal to the Ampere-Turns Product (AT) of the main winding 30.

It is noted that the main winding 30 is connected in circuit in series with the electrical load as shown in FIG. 4, i.e., the main winding 30 is "In-Line" with the load to which is being furnished AC electrical power at regulated voltage.

Based upon the 120 volt "electrical center", the main winding is arranged to provide an overall 18 volt (15%) buck or boost at its output terminal 32.

Considering FARADAY'S INDUCTION LAW, it is to be understood that the Volts per Turn (V/T) induced in the main winding 30 advantageously equals the sum of the Volts per Turn (V/T's) occurring in the particular regulator windings which happen to be active at any moment for providing regulating action.

Another way to consider the FARADAY INDUCTION LAW is to recognize that the magnetic flux 28 in each of the cores 21, 22, 23 and 24 is coupled to the main winding 30. The flux density in each core is the same. Thus, the total flux in each core is proportional to the cross-sectional area of that core. Therefore, the relative contributions of magnetic flux coupled to the main winding and being provided by the first, second, third and fourth cores 21, 22, 23 and 24 are in a ratio of 1 to 2 to 4 to 8. Consequently, the fourth core provides 8/15ths of the total flux coupled to the main core. The third core provides 4/15ths of this total flux; the second core provides 2/15ths of this total; and the first core provides 1/15th of this total. Thus, for example, the 8% regulator winding 4 will operate at 8/15ths of the Volts per Turn of the main winding 30; the 4% regulator winding will operate at 4/15ths of the Volts per Turn of the main winding, and so forth.

Since all of the regulator windings are being driven by the same voltage source 36, the voltage across their respective pairs of terminals is the same, therefore, the relative turns ratio of the regulator windings are selected to be the inverse of the step size; that is, the 8% winding 4 has one-eighth of the turns as does the 1% winding 1. The 4% winding 3 has one-fourth of the turns as does the 1% winding, and so forth. Referring again to LENZ'S LAW, since the Ampere-Turns Product (AT) for each of the four cores 21, 22, 23 and 24 are equal to the AT's of the main winding 30, the result is that fewer turns in a regulator winding causes larger current in that regulator winding and therefore causes a larger KVA to be associated with that particular regulator winding. A larger KVA requires a larger cross-sectional area of the respective core.

In summary, the chosen step sizes of the regulator windings, namely, 1%, 2%, 4% and 8% serves to apportion the relative KVA sizes of the respective regulator cores 21, 22, 23 and 24 and of their respective regulator windings 1, 2, 3 and 4.

For convenience of tabulation, the 1%, 2%, 4% and 8% regulator winding may be referred to, respectively, as the 1%, 2%, 4% and 8% "coil", and cores at 21, 22, 23 and 24 may be called, respectively, the 1%, 2%, 4% and 8% core. Taking into account the relationships explained in the above paragraphs, the parameters of this EXAMPLE I may be summarized as follows:

| WINDING TABULATION | | | |
|---|---|---|---|
| COIL | TURNS | AMPERES | A.T. |
| 1% | 896 | 1.00 | 900 |
| 2% | 448 | 2.01 | 900 |
| 4% | 224 | 4.02 | 909 |
| 8% | 112 | 8.04 | 900 |
| MAIN | 9 | 100.00 | 900 |

| CORE TABULATION (60 HZ BASE) | | | |
|---|---|---|---|
| CORE | BUILD | APPLIED VOLTAGE | V/T |
| 1% | ¼" | 120 | 0.134 |
| 2% | ½" | 120 | 0.268 |
| 4% | 1" | 120 | 0.536 |
| 8% | 2" | 120 | 1.072 |

A further advantage of this voltage-regulation apparatus 20 is noted, namely, since all of the regulator windings have the same Ampere-Turn Product, they all require the same area for their windows 27. In view of this criterion of same window area, it is advantageous to employ the same core frame size and same shape for all cores (as seen in front elevational view in FIG. 3). Thus the differing KVA ratings of the respective cores are provided by employing differing builds: 1B, 2B, 4B and 8B, i.e., by employing differing thicknesses of cores. As indicated above, these respective builds may, for example be ¼ inch, ½ inch, 1 inch and 2 inches. In the transformer apparatus 20 as shown, which is rated for 12 KVA at 120 volts, 100 amperes and 60 HZ and wherein the respective cores have "build" dimensions as tabulated above, the cores 21, 22, 23 and 24 may, for example as seen in FIG. 3, have a height of about five inches and a width of about six inches.

In FIG. 4 is shown an in-line buck/boost voltage-regulation system generally indicated at 50 and incorporating the voltage-regulation transformer apparatus 20 of FIGS. 1, 2 and 3. A system shut-off switch 42 is shown in circuit with the input terminal 31 of the main winding 30. The source 36 of AC electrical power is connected in circuit between the main input terminal 31 and an input "ground" terminal 46 which is directly connected by a lead 44 to the output "ground" terminal 39.

Connected across the pair of terminals 34-1 of the first regulator winding 1 is a transition switch S1 in series with a transition resistor R. Also, a winding-neutralizing switch S2 (a short-circuiting switch) is connected across this pair of terminals 34-1.

Similarly, a transition switch S1 in series with a transition resistor R is connected across the pair of terminals 34-2 of the second regulator winding 2. A winding-neutralizing switch S2 is connected across this pair of terminals 34-2. The third and fourth regulator windings 3 and 4 are similarly each equipped with a transition switch S1 in series with a transition resistor R and with a winding-neutralizing switch S2.

One of the terminals 34-1, 34-2, 34-3 and 34-4 of each regulator winding is connectable by a winding selection switch S3 to a first winding selection connection 47 leading to a "BOOST" winding selection switch S5 and also to a "BUCK" winding selection switch S7. The other terminal of each regulator winding is connected to a second winding selection connection 48 leading to a "BOOST" winding selection switch S6 and also to a "BUCK" winding selection switch S4.

OPERATION OF THE IN-LINE BUCK/BOOST VOLTAGE REGULATION SYSTEM SHOWN IN FIG. 4

In order to explain operation of the system 50 shown in FIG. 4, it will be assumed as an example of operation that this in-line buck/boost voltage regulation system is operating fully loaded by an electrical load 40. In this fully-loaded situation, the system 50 is supplying one hundred amperes to the load 40 at a regulated output voltage of 120 volts, i.e., 12 KVA of output power are being supplied to the load 40 at 60 Hz.

Since this is a fully loaded system 50, the substantial amount of power being drawn from AC source 36 is assumed to cause input voltage available between terminals 31 and 46 to be considerably less than 120 volts. Therefore, the regulation system 50 is assumed to be operating in its boost mode.

In this boost mode, it is assumed that the 8%, 2% and 1% windings are active, thereby providing a total of 11% of boost. Only the 4% winding 3 is inactive. These three active windings (4, 2 and 1) are connected across AC power source 36 via their respective three closed selection switches S3 and via the two connections 47 and 48 and via closure of the S5 and S6 boost switches. The three respective transition and neutralizing switches S1 and S2 are open for these three active windings 4, 2 and 1.

The inactive winding 3 is not connected to the AC power source 36; its selection switch S3 is open; and its neutralizing switch S2 is closed for short-circuiting this inactive winding. The reason for short circuiting any inactive winding will be explained by reference to the WINDING TABULATION set forth above. It is seen that the main winding 30 has 9 turns while the inactive 4% winding 3 has 224 turns. Thus, if winding 3 were permitted to be open-circuited (instead of being intentionally short-circuited) its open-circuit voltage would be 224/9 ths of the voltage across the main winding, which is operating at an 11% boost. As explained later, voltage across the main winding at 11% boost conditions is 11.9 volts. Consequently, if inactive winding 3 were permitted to be open-circuited, the voltage across its pair of terminals 34-3 would be 224/9 ths (which is 24.9) times 11.9 volts equals 296 volts. Such relatively high open-circuit voltage would be undesirable; thus neutralizing switch S2 is closed for inactive winding 3. This closure of a respective neutralizing switch occurs at any time for any inactive regulator winding.

At full load, as assumed, the main winding 30 is carrying 100 amperes in-line with load 40, which is drawing 100 amperes. All four cores 21, 22, 23 and 24 are electromagnetically coupled to the nine turns of the main winding; therefore, all four cores are being energized by 900 ampere-turns. All four regulator windings 1, 2, 3 and 4 will therefore have currents induced in them the magnitudes of which will be inversely proportional to their numbers of turns. In this case, for example, the 8% winding 4 will have a current of 900 AT divided by 112 turns equals 8.04 amperes. Similarly the 4% winding 3 will have a current of 900 AT divided by 224 turns equals 4.02 amperes, and so forth.

Since any inactive winding is always short-circuited, it is to be understood that current always is present in the four regulator windings, regardless of whether they are active or inactive. The magnitudes of these currents in the regulator windings depend directly upon the magnitude of the load current and are inversely proportional to the number of turns in the respective regulator winding.

As assumed above, the output from the fully loaded system 50 is 120 volts and since the three windings 4, 2 and 1 are active in the boost mode providing an 11% boost, the input voltage across the terminals 31 and 46 is calculated:

$$1/(1+0.11)\times 120\ v=0.90\times 120\ v=108.1\ \text{volts}. \quad (2)$$

The voltage across the main winding 30 is therefore 120 minus 108.1 volts equals 11.9 volts, which amounts to 1.32 volts per turn.

For purposes of further explanation, it is assumed that the voltage from AC supply 36 suddenly increases from 108.1 volts (which required an 11% boost) to 112.15 volts now suddenly requiring a 7% boost. Changing from an 11% boost to a 7% boost involves removing the 8% winding 4 from acting and replacing it with the 4% winding 3. The method in which this change is carried out will now be explained:

To remove the 8% winding 4 from being active, its selection switch S3 is opened, and to neutralize it, its switch S2 must be closed. Conversely, to make active the 4% winding 3, its neutralizing switch S2 must be opened and its selection switch S3 be closed. It is to be noted that if S2 and S3 switches were both closed at the same time for the same regulator winding they would present a direct short circuit across the AC power source 36 via connections 47 and 48. Moreover, if S2 and S3 switches were both open at the same time for the same regulator winding, that particular winding would have undesirably high open-circuit voltage appearing across its pair of terminals 34.

In order to provide a desirable sequencing of the switching operation: (a) without presenting a direct short circuit across the power source 36 and (b) without permitting any regulator winding to be in an open-circuit condition, (i) the transition resistor R and transition switch S1 are provided for each regulator winding, (ii) a specific (basic) switching sequence is used and (iii) the following two quiescent conditions are employed:

QUIESCENT CONDITION OF REGULATOR WINDING SWITCHES, WHEN A WINDING IS IN NEUTRALIZED CONDITION:

S1 CLOSED, S2 CLOSED AND S3 OPEN.

QUIESCENT CONDITION OF REGULATOR WINDING SWITCHES, WHEN A WINDING IS IN ACTIVE CONDITION:

S1 OPEN, S2 OPEN AND S3 CLOSED.

The basic switching sequence is as follows: To make a regulator winding active, first S2 is opened. The winding current flow (which previously was short-circuited through S2) now transfers to, i.e., the current is diverted to and is resistively diminished by the available transition path through S1 (which already was closed) and R. Then, after this diversion of current has occurred through the transition path S1 and R, S3 is closed. By closure of S3, the parallel combination of the regulator winding and S1 in series with R, is thereby connected across the input power source 36. Finally, S1 is opened to eliminate the unnecessary continued dissipation of power by the transition resistor R, thus making the regulator winding fully active.

To neutralize a regulator winding, first S1 is closed to make available a transition path for current flow. Then S3 is opened, and the winding current transfers to the transition path through S1 and R. Finally S2 is closed for short-circuiting the inactive regulator winding. Also, closure of S2 serves to short-circuit the transition path through S1 and R for eliminating unnecessary dissipation in the resistor R and, more importantly, for reducing impedance of the regulator system 50. Switch S1 is left closed, ready for the next sequence.

In this 1%, 2%, 4%, 8% regulator system 50, the boost-to-buck switching and the buck-to-boost switching is done as the AC power source 36 is traversing through an "electrical center" condition, i.e., the mode change from boost to buck and vice versa is carried out at "electrical center" condition. At electrical center condition, the supply voltage is at 120 volts. Therefore, no boosting nor bucking is occurring. Consequently, all four of the regulator windings are in neutralized status with all four of their neutralizing switches S2 being closed and all four of their selection switches S3 being open. Thus, no regulator winding current is flowing through the boost switches S5, S6 nor through the buck switches S4, S7. Since there is no winding current flowing through the buck nor boost switches when in this electrical center condition, the buck and boost switches do not require transition switches. In this embodiment of the invention it is intended that all regulator windings be in their neutralized state before a boost to buck (or vice versa), switch change occurs.

Where rapid response times in regulating voltage of power being supplied to an electrical load 40 are not important, for example with loads that have a high inertia or long time constant such as occurs in heating or air conditioning installations, then mechanical switches S1, S2, S3, S4, S5, S6 and S7 can be arranged to provide the desired sequence. Such mechanical switches may be driven by electrical solenoids or compressed air actuators.

Where fast response times are required, for example such as for regulating voltage of power being supplied to electronic equipment, then solid state switches may be used. The switching devices now available which are most suited to this purpose are SCRs and Triacs. In the case of SCRs being used for such switching, two of them are connected in inverse parallel to provide a bidirectional switch. The Triac is of itself bidirectional.

CONTROL SYSTEM

Figure 5:
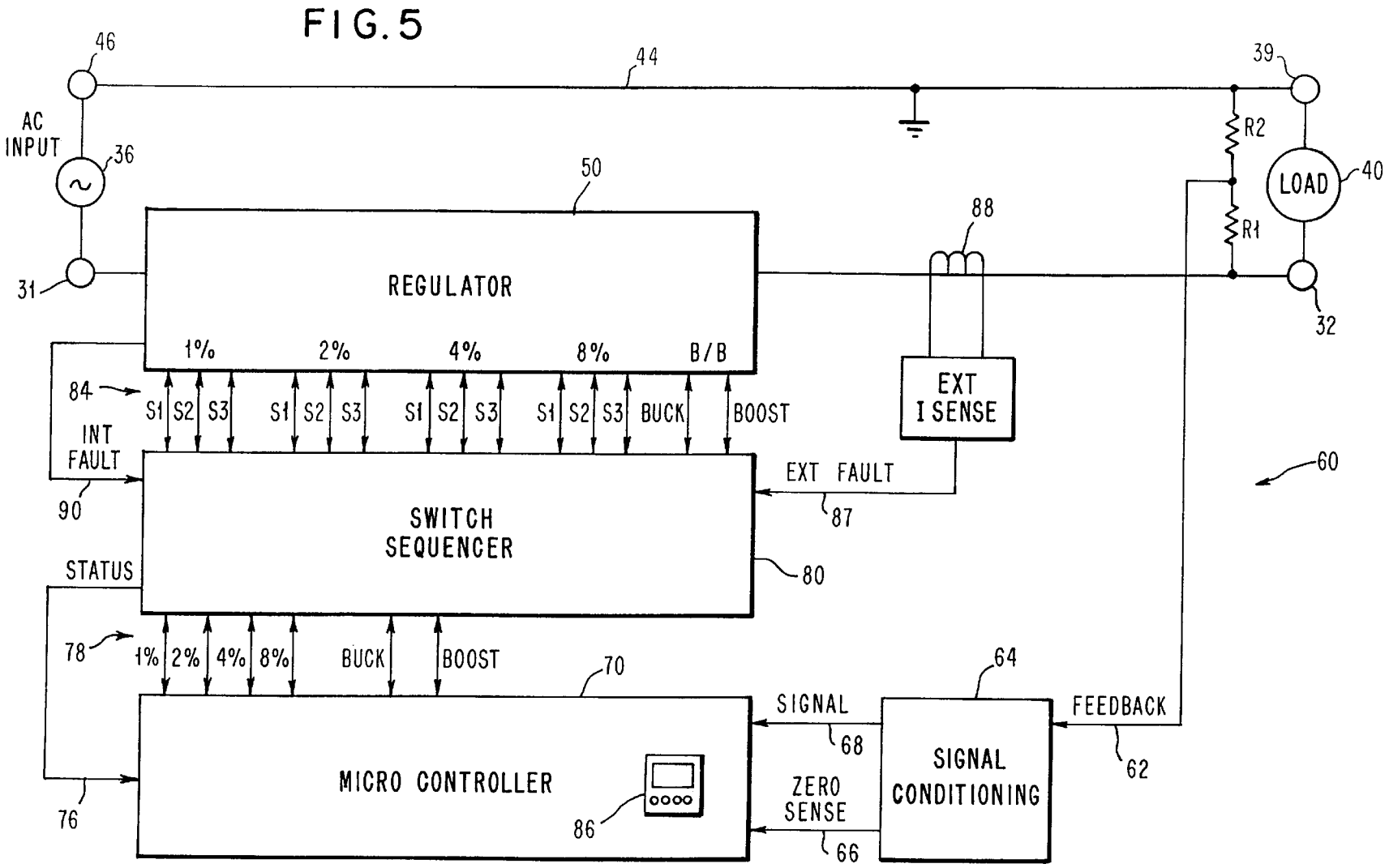
FIG. 5 is a functional block diagram of an automatic single-phase, voltage-regulation system embodying the invention.

For control of operation of the voltage-regulation system 50 (FIG. 4) a control system may be used as shown in FIG. 5. This control system is generally indicated by the reference number 60 and a summary of its overall functions will now be described. Controlling the regulator 50 involves monitoring of output voltage, detection of any error between that output and a desired reference output, conversion of any error to a digital code representing the required winding adjustment and finally, sequencing of the required switches to implement the adjustment.

1) Signal Conditioning: Resistors R1 and R2 connected across output terminals 32 and 39 provide a feedback signal 62 of output voltage. This feedback signal 62 is scaled and buffered as indicated by signal conditioning 64 and a short duration pulse 66 is generated at the zero crossings of the feedback signal 62 to provide synchronization. Both a buffered feedback signal 68 of output voltage and the zero-crossing pulse 66 are presented to a micro-controller 70.

2) Error Detection and A to D Conversion: Most AC voltage monitoring systems extract a mean or rms or peak value of the AC signal by a rectification and filtering process. Since response times of less than one cycle are desired in order to carry out switching at zero-axis crossings of the AC voltage, micro-controller 70 is arranged to employ a sample and hold technique so as to capture the peak amplitude of voltage of a single cycle. This peak amplitude data is then related to the desired peak value of output voltage, and appropriate adjustments are made. The sample and hold, error detection and analog-to-digital conversion are done by the micro-controller. The sequence of this control action is shown in FIG. 6 wherein time is increasing toward the right.

OPERATION OF CONTROL SYSTEM

Figure 6:
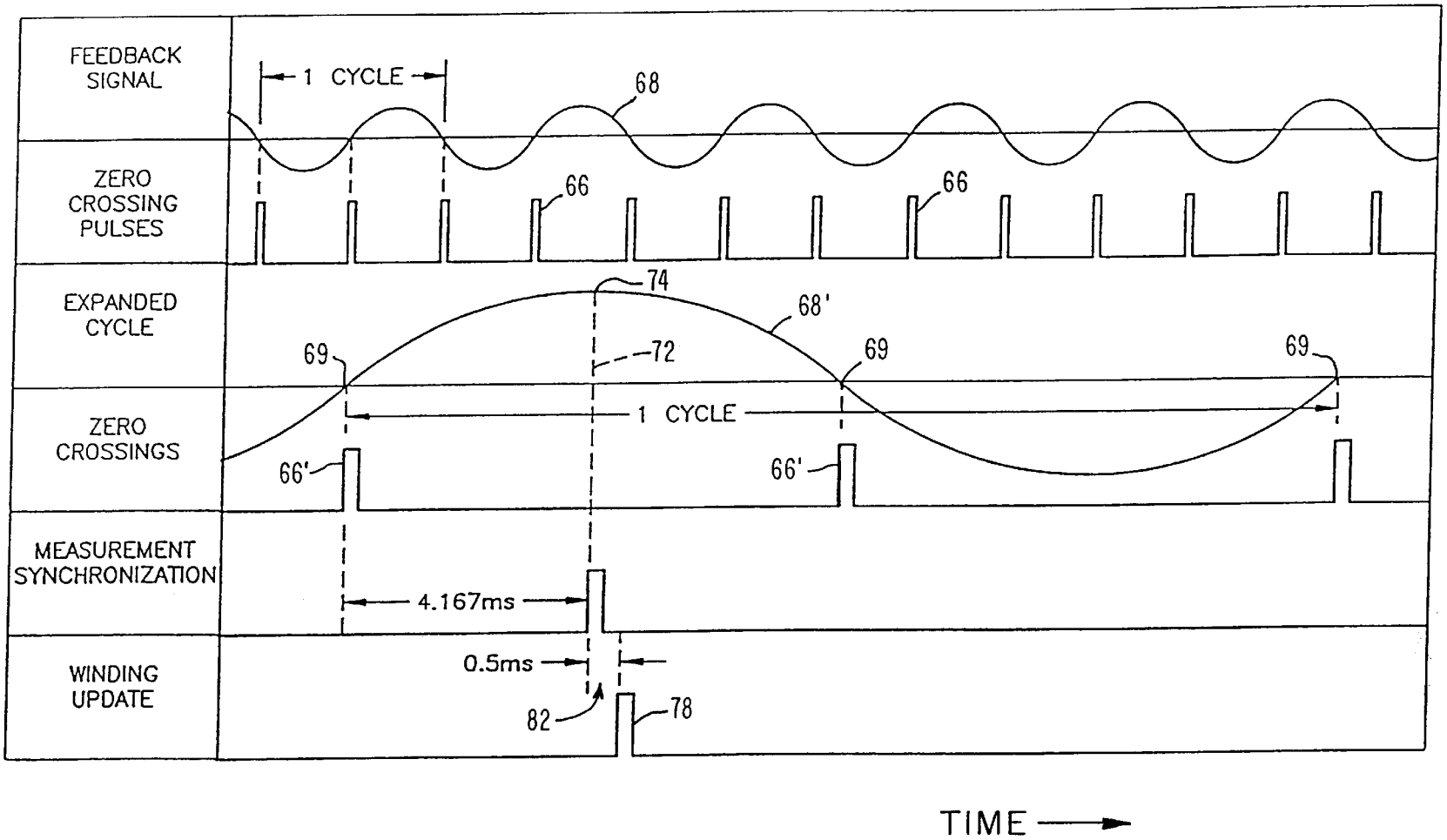
FIG. 6 includes plots for reference in explaining operation of the single-phase system of FIG. 5 for producing control-function switching at zero-crossing points of the AC voltage at each respective switch.

For ease of explaining operation of the control system 60 (FIG. 5), FIG. 6 shows both the buffered feedback signal 68 and the zero-crossing pulse 66 with an expanded time scale at 68' and 66', respectively. On this expanded scale, zero-crossing points are shown at 69.

The zero-crossing pulse 66 initiates a time delay of 4.167 milliseconds (¼ cycle of 60 Hz) inside of micro-controller 70. At the end of this 4.167 ms delay, the micro-controller immediately samples the peak value of buffered feedback signal 68. This sampling of the peak value is indicated by dashed line 72 (FIG. 6). The duration or aperture time of this sample 72 is very short relative to the 60 Hz signal 68. The absolute value of this sample 72 is taken to be the peak value 74 of feedback signal 68. The micro-controller then computes the error (if any) between that peak value 74 and the desired reference value. From that error the micro-controller determines the relative step size (±1% or ±2% or ±3% or ±4%, etc.) required to correct any error and adds (or subtracts) that step count to (from) the existing step count status 76 (FIG. 5). This updated step count is then presented at the output of the micro-controller as indicated generally at 78 (FIG. 5) and serves as an input into a switch sequencer 80. Implementation of this control algorithm may take micro-controller 70 about ½ millisecond, for example, as indicated at 82 in FIG. 6. The switch sequencer in response to input of the required updated step count data 78 (FIG. 5) controls all switches S1 through S7 (FIG. 4) in appropriate sequence, as indicated generally at 84 (FIG. 5) for producing the required percentage of boost or buck for maintaining the desired level of output voltage.

The desired output voltage may be set as a reference level, for example, by an operator entering data using a keypad 86 (FIG. 5). Alternatively, a predetermined, unchangeable fixed reference level, for example such as 120 volts, may be pre-set in the micro-controller, not subject to change by an operator.

3) Switch Sequencing: One of the aspects of the chosen switching devices (SCRs and Triacs) is that, while they are relatively easy to turn ON, they are not so easy to turn OFF. Fortunately, they naturally commutate OFF at the current zero crossings that occur every half cycle of the frequency of the input AC supply 36. The natural consequence of this repeated crossing of the zero axis by the input current is as follows:

a) These SCR or Triac switches S1 through S7 must be retriggered continually if they are required to stay ON.

b) They must be allowed to commutate OFF and then be allowed some recovery time, before they can withstand re-application of forward voltage.

As explained earlier, appropriate switch sequencing is required to divert the winding current through a transition path S1 and R during switching transition of a regulator winding from inactive to active state (or vice versa). The switches themselves impose a limit on the maximum speed at which a given transition can occur. By monitoring switch condition and determining exactly when the switch is fully ON or fully OFF, it is possible to optimize the switching sequence for providing maximum speed of switching transitions.

There are two described ways to determine the ON or OFF condition of a given switch: One way is to sense the current through the switch. When the current is zero, the switch is fully OFF and vice versa. Another way to monitor ON or OFF condition is to monitor the voltage across the switch. When the voltage is zero, the switch is fully ON and vice versa. In the present system voltage monitoring is employed.

With reference to FIG. 5, the switch sequencer 80 may include zero-crossing switch sequencing capability, therefore comprising:

a) Voltage zero-crossing sensors that also indicate the condition of the switch (ON or OFF). The function arrows 84 are double-headed for indicating both controlling and signal-sending functions.

b) ON sequence and OFF sequence logic circuits;

c) Status sensing circuits that constantly monitor the switching sequences and convey to micro-controller 70 the integrity of the system as indicated by the status function 76. The function arrows 78 are double-headed for indicating both controlling and signal-sending functions.

The switch sequencer 80 also receives overcurrent fault information 87 (during external fault conditions), from a current-sensing transformer 88. In the event of an external fault, the switch sequencer 80 acts so as to "freeze" the existent active or inactive status of each regulator winding. Internal fault information 90 is provided from the regulator system 50 to the switch sequencer 80. In the event of an internal fault, the switch sequencer 80 attempts to clear the internal fault by forcing the Buck and Boost switches open.

Figure 7:
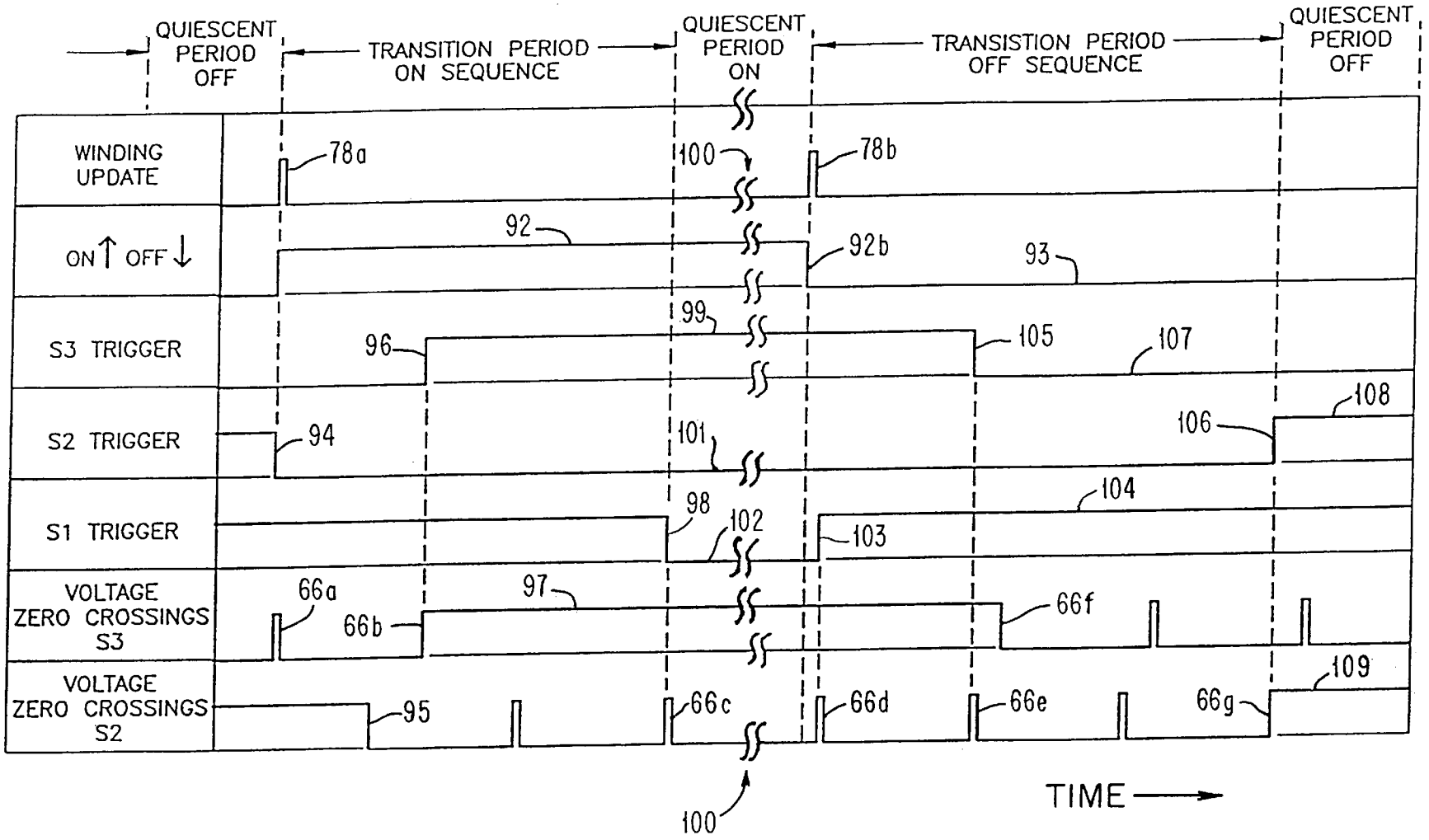
FIG. 7 includes further plots for explaining single-phase timing sequences for producing control-function switching at such zero-crossing points.

Referring to the plots of FIG. 7, this is a timing diagram of the switching sequence during the ON and OFF sequence for a typical regulator winding that employs solid state switches (SCRs and TRIACS). Each of the control signals has two states, a HIGH or a LOW as indicated by the ON and OFF arrows, that varies during the control cycle. Time increases toward the right.

There follows an explanation of an ON and OFF switching sequence that is typical for any of the regulator windings. The sequence is designed to be self commutating and self monitoring, that is a particular action initiated by the micro-controller or the switch sequencer, requires a particular reaction, as indicated by the zero crossing detectors before a subsequent action is initiated. Failure of the zero crossing detectors to provide the required response within a given time is interpreted as an "INTERNAL FAULT".

The initial condition of this regulator winding will be OFF, therefore the following conditions apply during the initial quiescent period at the left in FIG. 7:

i) S3 TRIGGER is LOW and the selection switch S3 is open (OFF).

ii) S2 TRIGGER is HIGH and the neutralizing switch S2 is closed (ON).

iii) S1 TRIGGER is HIGH and the transition switch S1 is closed (ON).

Also:

iv) Because S3 is open and S2 is closed, the full phase to neutral supply AC voltage appears across switch S3. This causes the zero crossing detectors associated with that switch to be active, VOLTAGE ZERO CROSSINGS S3 actively indicates the AC voltage zero crossings by producing a short high-going pulse at the voltage zeros, 66*a*.

v) Because S2 is closed (ON) there is a short circuit across this particular regulator winding and the AC voltage across this switch is virtually zero. In this case the VOLTAGE ZERO CROSSINGS S2 are inactive, as indicated by the continuous HIGH state of that signal.

These initial conditions are referred to on the plot FIG. 7 as the "QUIESCENT PERIOD OFF".

An ON sequence (during "TRANSITION PERIOD ON SEQUENCE") requires that S2 be opened, S3 be closed and finally S1 be opened, in that order.

An ON sequence begins when the micro-controller 70, having determined that a regulator winding change is necessary to correct for an input voltage change, sets the ON/OFF signal for a particular regulator winding HIGH (ON) 92, and initiates a WINDING UPDATE command signal 78*a*. The switch sequencer 80 then initiates the switching operation as follows:

i) Switch S2 is caused to revert to its OFF state by removal of the trigger signal, S2 TRIGGER is forced LOW as shown at 94. The switch continues to conduct (stay ON) until the AC current through the switch traverses a current zero. At this point with zero current through the device and with no trigger signal applied, S2 reverts to its OFF state.

ii) The regulator winding current that was being conducted through S2 is diverted through the transition switch S1 and resistor R. This causes the AC voltage across switch S2 to increase and activate the S2 zero crossing detectors. The signal VOLTAGE ZERO CROSSING S2 therefore goes LOW as shown at 95, and the detector produces a short high-going pulse at each of the voltage zeros.

iii) The first HIGH to LOW transition shown at 95 of VOLTAGE ZERO CROSSING S2 after removal of S2 TRIGGER is confirmation that the switch S2 has in fact reverted to the OFF state. This transition 95 causes the switch sequencer to initiate a timer that counts down a certain time period, at the end of which S3 TRIGGER is forced HIGH as shown at 96. The application of a trigger to switch S3 causes it immediately to revert to its ON state. When ON the AC voltage across S3 is virtually zero, and the zero crossing detector becomes inactive, as indicated by the LOW to HIGH transition at 66*b* of VOLTAGE ZERO CROSSING S3.

iv) The LOW to HIGH transition at 66*b* of VOLTAGE ZERO CROSSING S3 is confirmation that S3 has reverted to its ON state. This transition 66*b* causes the switch sequencer to initiate a timer that counts down a certain time period, at the end of which the trigger signal S1 TRIGGER is forced low as shown at 98, coincident with the zero crossing of S2 as indicated by pulse 66*c*. With no trigger signal applied to S1 the device reverts to its OFF state at the next AC current zero.

This completes an ON sequence. The system remains ON, as indicated by the time breaks 100, remaining in this "QUIESCENT PERIOD ON" until such time as an AC input voltage change causes the micro-controller to select an alternate combination of regulator windings for maintaining the required AC output voltage.

The switch states during the On condition are:

i) S3 TRIGGER is HIGH 99 and the selection switch S3 is closed (ON).

ii) S2 TRIGGER is LOW 101 and the neutralizing switch S2 is open (OFF).

iii) S1 TRIGGER is LOW 102 and the transition switch S1 is open (OFF).

Also:

iv) Because S3 is closed and S2 is open, the full phase to neutral supply AC voltage appears across switch S2. This causes the zero crossing detectors associated with that switch to be active. VOLTAGE ZERO CROSSINGS S2 actively indicates the AC voltage zero crossings by producing a short high-going pulse at each of the voltage zeros.

v) Because S3 is closed, the AC voltage across this switch is virtually zero. In this case the VOLTAGE ZERO CROSSINGS S3 are inactive, as indicated by the HIGH state of that signal.

An OFF sequence (during "TRANSITION PERIOD OFF SEQUENCE") requires that S1 be closed, S3 be opened and S2 be closed, in that order.

An OFF sequence begins when the micro-controller 70 sets the ON/OFF signal for a particular regulator winding LOW (OFF) as shown by a transition at 92*b* to the LOW 93 and initiates a WINDING UPDATE command signal 78*b*. The switch sequencer 80 then initiates the switching operation as follows:

i) At the first occurrence of a zero crossing of the AC voltage across S2 following the winding update signal 78*b*, there is a VOLTAGE ZERO CROSSINGS S2 pulse at 66*d*, and the S1 TRIGGER is set HIGH 103. The switch S1 immediately reverts to its conducting state, and the transition resistor R therefore is connected in parallel with the regulator winding.

ii) A count down timer then is initiated, and at the next zero crossing of the AC voltage across S2 as indicated by pulse 66*e*, S3 TRIGGER is forced LOW as shown at 105. S3 continues to conduct (stay ON) until the AC current traverses a current zero. With no trigger applied to the switch S3 as shown by the LOW 107 and with zero current through it, the switch device S3 reverts to its OFF state.

iii) The first HIGH to LOW transition as shown at 66*f* of VOLTAGE ZERO CROSSING S3 after the removal of S3 trigger is confirmation that the switch S3 has in fact reverted to the OFF state. This transition at 66*f* causes the switch sequencer to initiate a timer that counts down a certain time period. At the end of this time count, coincident with the AC voltage zero crossing of S2, there is a VOLTAGE ZERO CROSSINGS S2 pulse at 66*g*, and the S2 TRIGGER is forced HIGH as shown at 106. The application of a trigger to switch S2 causes it immediately to revert to its ON state. When ON the AC voltage across S2 is virtually zero, and the zero crossing detector becomes inactive, as is indicated by the continuous HIGH state of VOLTAGE ZERO CROSSINGS S3 shown at 109.

This completes an OFF sequence. The Switches S1, S2 remain ON as shown by the HIGH of 104 and 108, and S3 remains OFF, ready for the next sequence.

EXAMPLE II

THREE-PHASE IN-LINE BUCK/BOOST VOLTAGE-REGULATION TRANSFORMER APPARATUS

Figure 8:
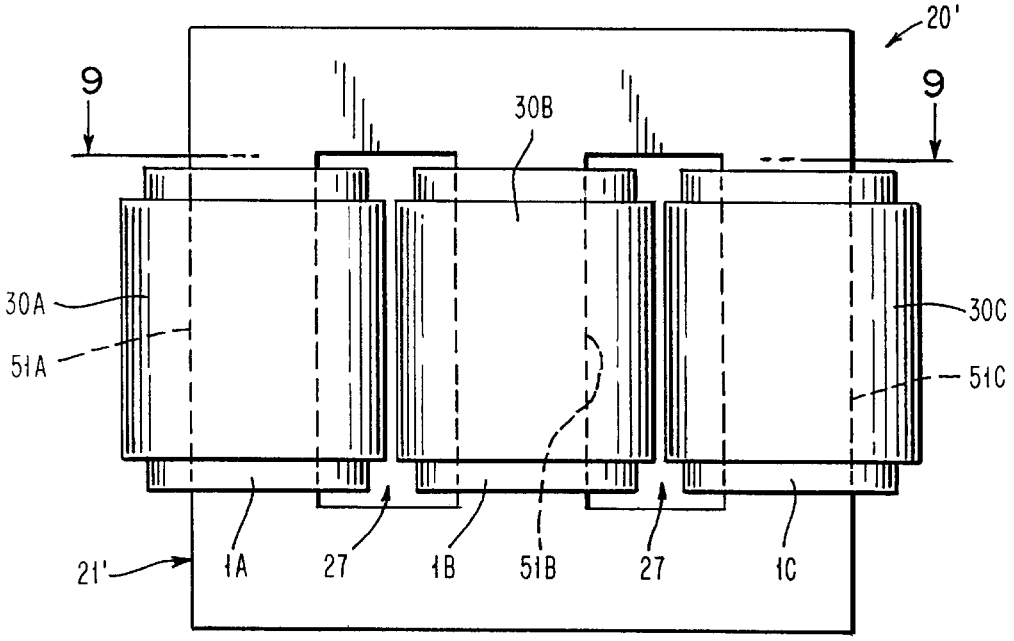
FIG. 8 is an elevational view of a three-phase, in-line, buck/boost, voltage-regulation transformer apparatus embodying the present invention.
Figure 9:
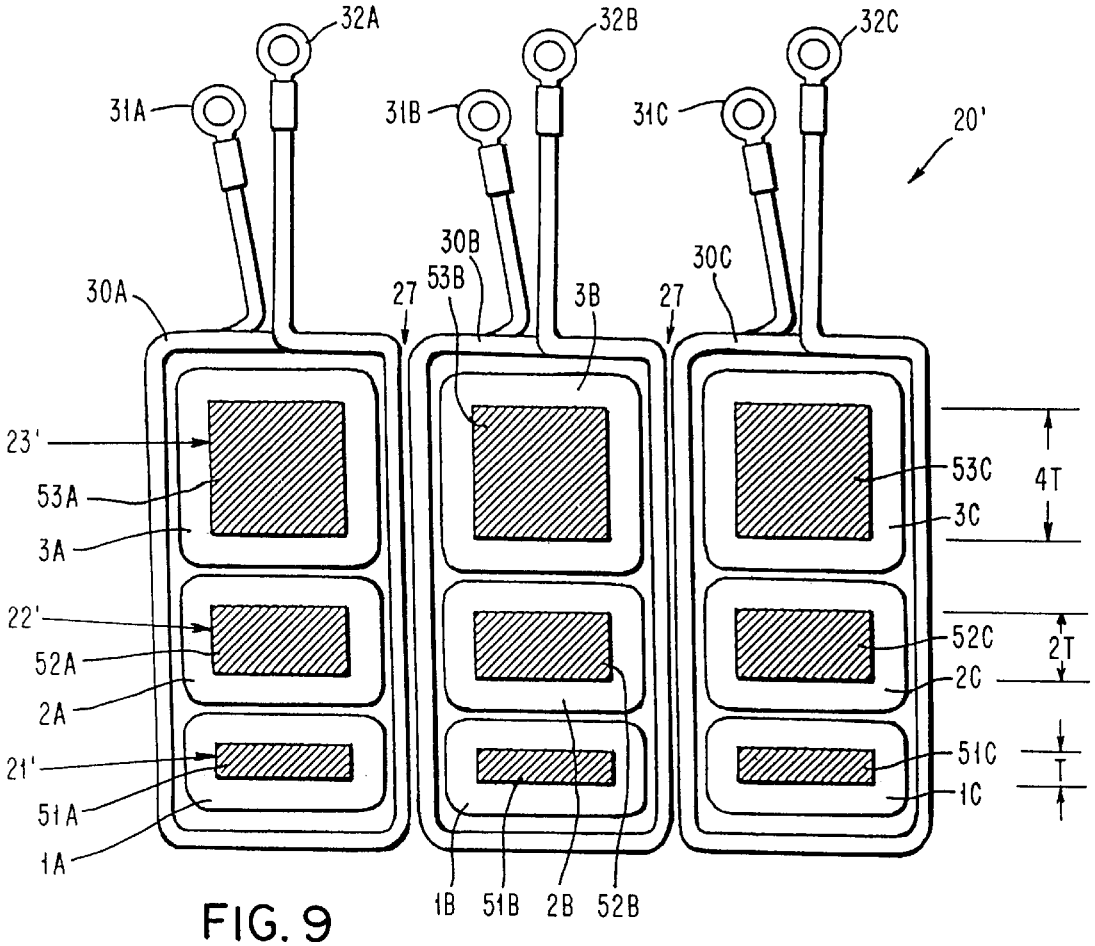
FIG. 9 is a plan cross-sectional view taken along the plane 9—9 through the three-phase voltage-regulation transformer apparatus of FIG. 8.

In FIGS. 8 and 9 is shown a three-phase, in-line, buck/boost voltage-regulation transformer 20' which has three regulator windings per phase and which embodies the present invention. This transformer includes three three-phase cores, generally indicated at 21', 22' and 23' all of the same height and width and with winding windows 27 in each core all of the same size and shape. These three cores have different build thicknesses T, 2T and 4T for accommodating the relative ratios of the regulator windings in this three-phase transformer. There are three regulator windings 1A, 1B and 1C mounted on and electromagnetically coupled essentially solely with legs 51A, 51B and 51C, respectively, of core 21'. There are three regulator windings 2A, 2B and 2C mounted on and electro-magnetically coupled essentially solely with legs 52A, 52B and 52C, respectively, of core 22'; and there are three regulator windings 3A, 3B and 3C mounted on and electromagnetically coupled essentially solely with legs 53A, 53B and 53C, respectively, of core 23'. The descriptive phrase "coupled essentially solely with" as used in description and/or claims is intended to mean neglecting any incidental coupling caused by stray electromagnetic flux. These respective regulator windings for the "A", "B" and "C" phases are designed for voltage regulation effects of 3%, 6% and 12%, respectively, and are called the 3%, 6% and 12% windings, respectively. A first main winding 30A, the "A" phase winding, encircles and electromagnetically couples with legs 51A, 52A and 53A of all three cores. A second main winding 30B, the "B" phase winding, encircles and electromagnetically couples with legs 51B, 52B and 53B of all three cores. A third main winding 30C, the "C" phase winding, encircles and electromagnetically couples with legs 51C, 52C and 53C of all three cores. These main windings have respective input and output terminals 31A and 32A, 31B and 32B, and 31C and 32C.

As an example, this transformer 20' may have an input rating of 208 volts, 60 Hz, 50 KVA, −17% and +25% and an output of 208 volts, 50 KVA, ±3% for providing a 3% resolution over a 21% range relative to the electrical center output voltage of 208 volts. At 208 volts, a 50 KVA rating involves a three-phase current of 138 amperes.

In order to provide 3% resolution (3% steps) over a plus or minus range of 21%, the regulating action is expressed in the following table. For convenience and clarity of tabulations, the regulator windings (also called "COILS") are listed as 1, 2 and 3 wherein "1" means that all three phases of regulator windings 1A, 1B and 1C are active, "2" means that all three phases of regulator windings 2A, 2B and 2C are active, and so forth. A plus sign indicates boost mode and a minus sign indicates buck mode:

| Regulating Action provided: | Regulator Winding(s) Involved: |
|---|---|
| 0 | 0 |
| +3% | +1 |
| +6% | +2 |
| +9% | +2 +1 |
| +12% | +3 |
| +15% | +3 +1 |
| +18% | +3 +2 |
| +21% | +3 +2 +1 |
| −3% | −1 |
| −6% | −2 |
| −9% | −2 −1 |
| −12% | −3 |
| −15% | −3 −1 |
| −18% | −3 −2 |
| −21% | −3 −2 −1 |

WINDING TABULATION

| COIL | TURNS | AMPERES | A.T. |
|---|---|---|---|
| 1 3% | 460 | 4.2 | 1932 |
| 2 6% | 230 | 8.4 | 1932 |
| 3 12% | 115 | 16.8 | 1932 |
| MAIN | 14 | 138 | 1932 |

-continued

CORE TABULATION (60 HZ BASE)

| CORE | BUILD | APPLIED VOLTAGE | V/T |
|---|---|---|---|
| 3% | ½" | 120 | 0.261 |
| 6% | 1" | 120 | 0.522 |
| 12% | 2" | 120 | 1.044 |

With a build (thickness) of ½", 1" and 2", the three in elevation in FIG. 8 may have a height of 11" and a width of 12" for suitably providing a 3Φ50 KVA rating capability at 208 volts and 60 5Hz.

CONTROL SYSTEM

Figure 10A:
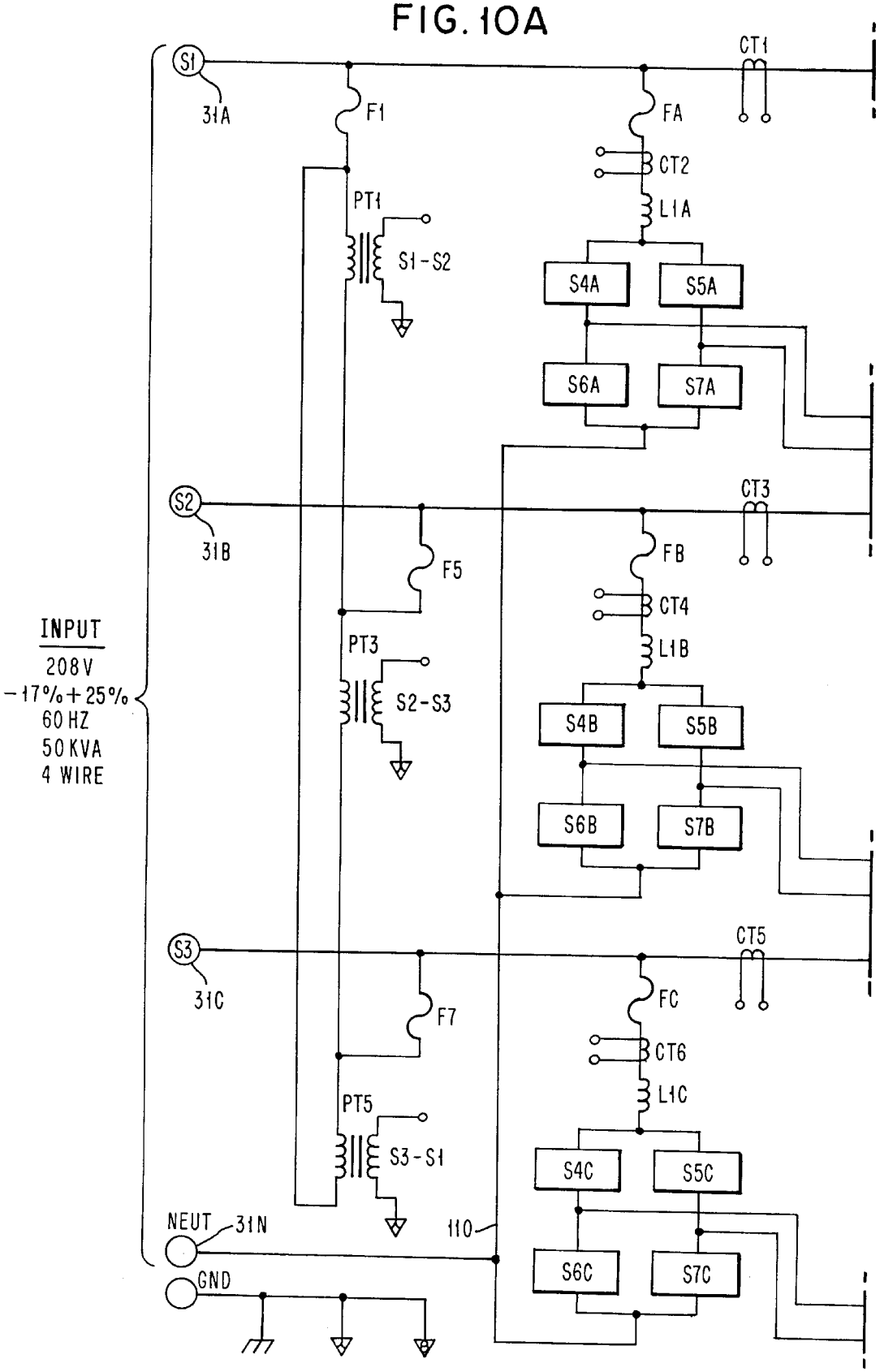
FIG. 10 is a schematic circuit diagram showing a three-phase voltage-regulation system embodying the invention.
Figure 10B:
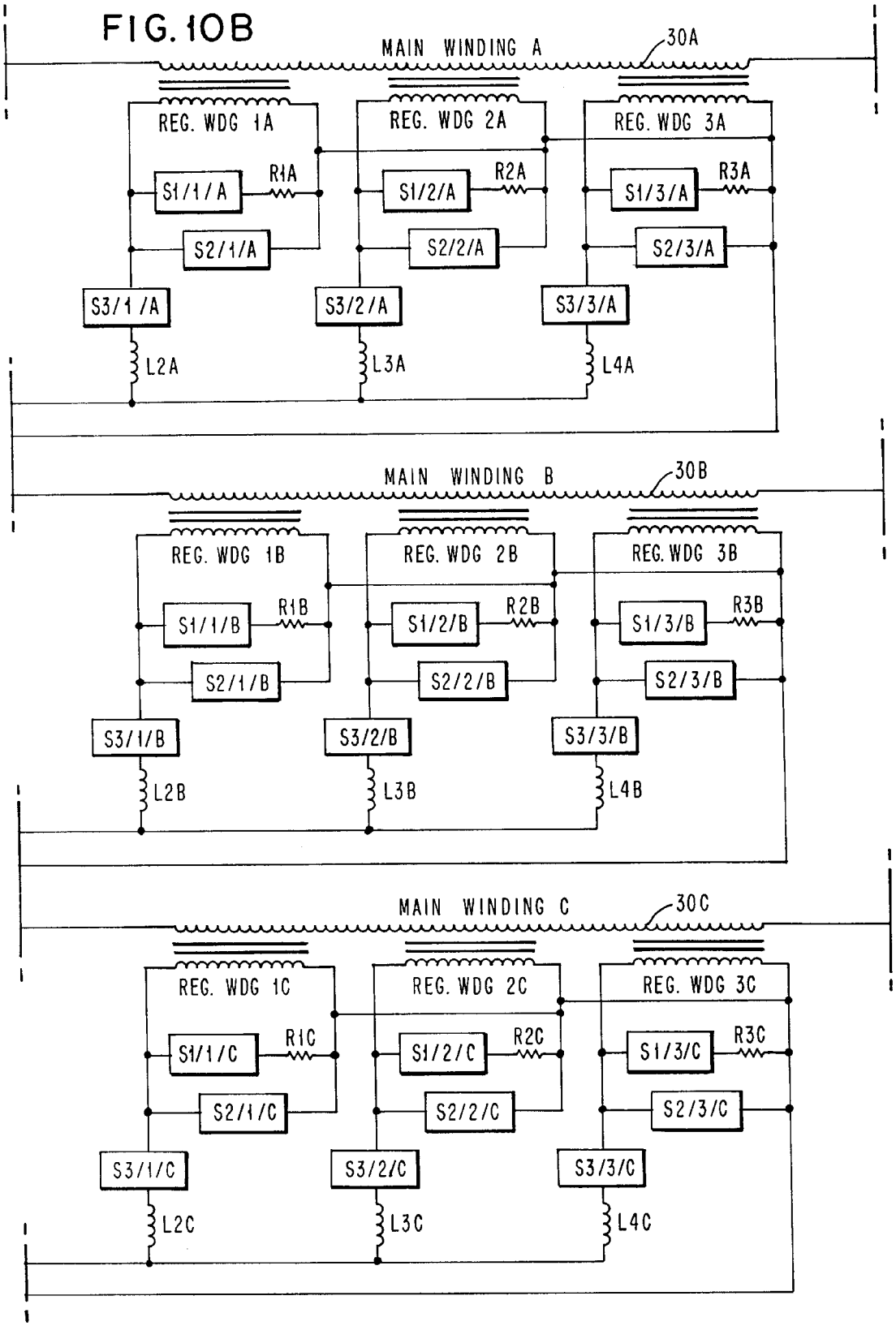
Figure 10C:
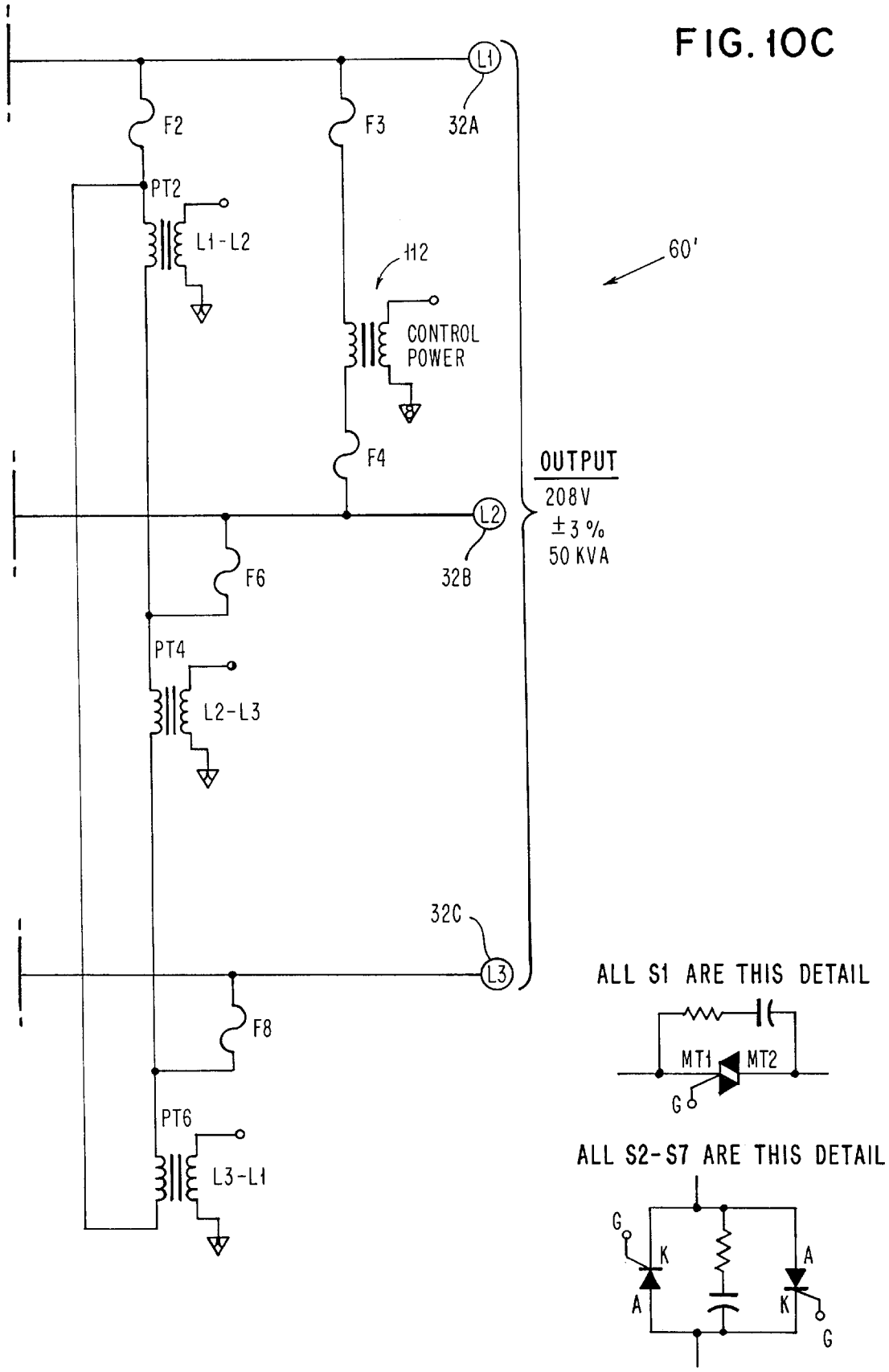

FIG. 10 shows a 3-phase control system, generally indicated at 60' for the 3-phase regulator transformer 20' (FIGS. 8 and 9).

The three input terminals are shown at 31A, 31B and 31C with three output terminals 32A, 32B and 32C. The input includes a fourth terminal 31N for neutral connection to a three-phase WYE AC supply; whereas, the output is arranged with three terminals for connection to a three-phase DELTA load.

The "BUCK" and "BOOST" switches and the associated regulator winding circuits for the A, B and C phases are shown in a WYE arrangement with a neutral connection 110. The "BUCK" switches are shown at S4A and S7A, S4B and S7B, and S4C and S7C for the A, B and C phases, respectively. The "BOOST" switches are shown at S5A and S6A, S5B and S6B, and S5C and S6C for the A, B and C phases, respectively. These BUCK and BOOST switches may comprise inverse parallel SCR devices arranged as shown at lower right in FIG. 10.

Neutralizing (short-circuiting) switches for the regulator windings 1A, 2A, 3A and 1B, 2B, 3B and 1C, 2C, 3C for the A, B and C phases are shown respectively at S2/1/A, S2/2/A, S2/3/A, and at S2/1/B, S2/2/B, S2/3/B and at S2/1/C, S2/2/C, S2/3/C. These solid-state neutralizing switches S2 may be arranged for example as shown at lower right in FIG. 10 by using inverse parallel SCR devices.

Transition switches with their respective transition resistors for the regulator windings for the A, B and C phases are shown respectively at S1/1/A, S1/2/A, S1/3/A, with R1A, R2A, R3A, and at S1/1/B, S1/2/B, S1/3/B, with R1B, R2B and R3B, and at S1/1/C, S1/2/C, S1/3/C with R1C, R2C, R3C. These solid-state transition switches S1 may be inverse parallel SCRs or Triacs arranged as shown at lower right in FIG. 10.

Selection switches for the regulator windings for the A, B and C phases are shown respectively at S3/1/A, S3/2/A, S3/3/A, and S3/1/B, S3/2/B, S3/3/B and at S3/1/C, S3/2/C, S3/3/C. The selection switches S3 may be inverse parallel SRCs arranged as shown at lower right in FIG. 10.

Potential transformers PT1, PT3 and PT5 sense the phase-to-phase supply voltages between pairs of input terminals 31A and 31B, 31B and 31C, 31C and 31A for furnishing this input voltage data to a switch sequencer and micro-processor similar to those shown at 80 and 70 (FIG. 5), except that the switch sequencer and micro-controller for the control system 60' (FIG. 10) are arranged for three-phase control.

Potential transformers PT2, PT4 and PT6 monitor the phase-to-phase output voltages between pairs of terminals 32A and 32B, 32B and 32C and 32C and 32A for transmitting this output voltage data to the switch sequencer and micro-processor (not shown). Ground connections for the secondary windings of the various potential transformers are shown at ▽A▽.

Current transformers CT1, CT3 and CT5 provide data regarding magnitudes of current flowing in each of the three main windings for phases A, B and C, respectively, for sensing undue imbalances, overloads and faults. Current transformers CT2, CT4 and CT6 furnish data regarding current flowing in each of the three regulator winding circuits for phases A, B and C respectively.

Control power at regulated voltage is shown being supplied by a transformer 112 connected between output terminals 32A and 32B and with a ground connection for its secondary winding at ▽B▽. Suitable Fuses F are included for protecting the potential transformer circuits, the control power circuit and the regulator windings circuits.

OTHER EXAMPLES

It will be appreciated that the present invention enables a wide variety of in-line buck/boost voltage-regulation systems and apparatus to be designed advantageously for meeting the requirements of numerous installations. The two examples described above utilize regulator windings whose ratios were chosen so as to limit the number of switches required to obtain the overall regulator range. In those examples, the polarity or "sense" of the windings, whether they were in buck or boost configuration, were controlled by one set of buck/boost switches, in the case of EXAMPLE I, and were controlled by one set of buck/boost switches per phase in the case of EXAMPLE II. In those two examples the relative ratios of the regulator windings were such that it was only necessary to change the sense of the windings, for example from buck to boost, at the electrical center of the regulating range. Then all regulator windings were changed together, as a group.

Other regulator winding ratios can be utilized that would require the sense of the individual regulator windings to be changed at other than the electrical center. Such an arrangement is used in EXAMPLE III (to follow) where for example, the +4% regulator position requires a +7% regulator winding to be used with a −2% and −1% winding. In the following examples (as in the previous regulator range tables), the polarity or sense of the regulator windings, whether they are in buck or boost, is indicated by a "−" sign in the case of buck, and a "+" sign in the case of boost. Examples of these installations are: for lighting, heating, air conditioning, transmitters, computers, process controllers, glass furnaces, electrical ovens, medical instrumentation, scanning devices, etc.

EXAMPLE III

Using 1%, 2% and 7% regulator windings (respectively called regulator windings 1, 2 and 7) regulation of voltage is provided over a range of plus or minus ten percent, in one percent steps as follows:

| Regulating Action Provided: | Regulator Winding(s) Involved: |
|---|---|
| 0 | 0 |
| +1% | +1 |
| +2% | +2 |
| +3% | +2 +1 |
| +4% | +7 −2 −1 |

-continued

| Regulating Action Provided: | Regulator Winding(s) Involved: |
|---|---|
| +5% | +7 −2 |
| +6% | +7 −1 |
| +7% | +7 |
| +8% | +7 +1 |
| +9% | +7 +2 |
| +10% | +7 +2 +1 |
| −1% | −1 |
| −2% | −2 |
| −3% | −2 −1 |
| −4% | −7 +2 +1 |
| −5% | −7 +2 |
| −6% | −7 +1 |
| −7% | −7 |
| −8% | −7 −1 |
| −9% | −7 −2 |
| −10% | −7 −2 −1 |

EXAMPLE IV

Using 2%, 4% and 14% regulator windings, respectively called regulator windings 2, 4 and 14, regulation of voltage is provided over a range of plus or minus twenty percent in two percent steps as follows:

| Regulating Action Provided: | Regulator Winding(s) Involved: |
|---|---|
| 0 | 0 |
| +2% | +2 |
| +4% | +4 |
| +6% | +4 +2 |
| +8% | +14 −4 −2 |
| +10% | +14 −4 |
| +12% | +14 −2 |
| +14% | +14 |
| +16% | +14 +2 |
| +18% | +14 +4 |
| +20% | +14 +4 +2 |
| −2% | −2 |
| −4% | −4 |
| −6% | −4 −2 |
| −8% | −14 +4 +2 |
| −10% | −14 +4 |
| −12% | −14 +2 |
| −14% | −14 |
| −16% | −14 −2 |
| −18% | −14 −4 |
| −20% | −14 −4 −2 |

EXAMPLE V

Using 1%, 2%, 4%, 8% and 16% regulator windings, (respectively called regulator windings 1, 2, 4, 8 and 16) regulation in voltage is provided over a range of plus or minus thirty-one percent in steps of one percent, as shown below. Moreover, all active windings are in the same mode. In other words, in this Example V there is no simultaneous mixture of both buck and boost modes. All changes from buck mode to boost mode occur at the "electrical center".

| Regulating Action Provided: | Regulator Winding(s) Involved: |
|---|---|
| 0 | 0 |
| +1% | +1 |
| +2% | +2 |
| +3% | +2 +1 |
| +4% | +4 |
| +5% | +4 +1 |
| +6% | +4 +2 |

-continued

| Regulating Action Provided: | Regulator Winding(s) Involved: |
|---|---|
| +7% | +4 +2 +1 |
| +8% | +8 |
| +9% | +8 +1 |
| +10% | +8 +2 |
| +11% | +8 +2 +1 |
| +12% | +8 +4 |
| +13% | +8 +4 +1 |
| +14% | +8 +4 +2 |
| +15% | +8 +4 +2 +1 |
| +16% | +16 |
| +17% | +16 +1 |
| +18% | +16 +2 |
| +19% | +16 +2 +1 |
| +20% | +16 +4 |
| +21% | +16 +4 +1 |
| +22% | +16 +4 +2 |
| +23% | +16 +4 +2 +1 |
| +24% | +16 +8 |
| +25% | +16 +8 +1 |
| +26% | +16 +8 +2 |
| +27% | +16 +8 +2 +1 |
| +28% | +16 +8 +4 |
| +29% | +16 +8 +4 +1 |
| +30% | +16 +8 +4 +2 |
| +31% | +16 +8 +4 +2 +1 |
| −1% | −1 |
| −2% | −2 |
| −3% | −2 −1 |
| −4% | −4 |
| −5% | −4 −1 |
| −6% | −4 −2 |
| −7% | −4 −2 −1 |
| −8% | −8 |
| −9% | −8 −1 |
| −10% | −8 −2 |
| −11% | −8 −2 −1 |
| −12% | −8 −4 |
| −13% | −8 −4 −1 |
| −14% | −8 −4 −2 |
| −15% | −8 −4 −2 −1 |
| −16% | −16 |
| −17% | −16 −1 |
| −18% | −16 −2 |
| −19% | −16 −2 −1 |
| −20% | −16 −4 |
| −21% | −16 −4 −1 |
| −22% | −16 −4 −2 |
| −23% | −16 −4 −2 −1 |
| −24% | −16 −8 |
| −25% | −16 −8 −1 |
| −26% | −16 −8 −2 |
| −27% | −16 −8 −2 −1 |
| −28% | −16 −8 −4 |
| −29% | −16 −8 −4 −1 |
| −30% | −16 −8 −4 −2 |
| −31% | −16 −8 −4 −2 −1 |

EXAMPLE VI

Using 1%, 2%, 7% and 21% regulator windings (respectively called windings 1, 2, 7, 21) regulation of voltage is provided over a range of plus or minus thirty-one percent in steps of one percent, as shown below. Simultaneous mixtures of both buck and boost modes are employed.

| Regulating Action Provided: | Regulator Winding(s) Involved: |
|---|---|
| 0 | 0 |
| +1% | +1 |
| +2% | +2 |
| +3% | +2 +1 |
| +4% | +7 −2 −1 |
| +5% | +7 −2 |

-continued

| Regulating Action Provided: | Regulator Winding(s) Involved: |
|---|---|
| +6% | +7 −1 |
| +7% | +7 |
| +8% | +7 +1 |
| +9% | +7 +2 |
| +10% | +7 +2 +1 |
| +11% | +21 −7 −2 −1 |
| +12% | +21 −7 −2 |
| +13% | +21 −7 −1 |
| +14% | +21 −7 |
| +15% | +21 −7 +1 |
| +16% | +21 −7 +2 |
| +17% | +21 −7 +2 +1 |
| +18% | +21 −2 −1 |
| +19% | +21 −2 |
| +20% | +21 −1 |
| +21% | +21 |
| +22% | +21 +1 |
| +23% | +21 +2 |
| +24% | +21 +2 +1 |
| +25% | +21 +7 −2 −1 |
| +26% | +21 +7 −2 |
| +27% | +21 +7 −1 |
| +28% | +21 +7 |
| +29% | +21 +7 +1 |
| +30% | +21 +7 +2 |
| +31% | +21 +7 +2 +1 |
| −1% | −1 |
| −2% | −2 |
| −3% | −2 −1 |
| −4% | −7 +2 +1 |
| −5% | −7 +2 |
| −6% | −7 +1 |
| −7% | −7 |
| −8% | −7 −1 |
| −9% | −7 −2 |
| −10% | −7 −2 −1 |
| −11% | −21 +7 +2 +1 |
| −12% | −21 +7 +2 |
| −13% | −21 +7 +1 |
| −14% | −21 +7 |
| −15% | −21 +7 −1 |
| −16% | −21 +7 −2 |
| −17% | −21 +7 −2 −1 |
| −18% | −21 +2 +1 |
| −19% | −21 +2 |
| −20% | −21 −1 |
| −21% | −21 |
| −22% | −21 −1 |
| −23% | −21 −2 |
| −24% | −21 −2 −1 |
| −25% | −21 −7 +2 +1 |
| −26% | −21 −7 +2 |
| −27% | −21 −7 +1 |
| −28% | −21 −7 |
| −29% | −21 −7 −1 |
| −30% | −21 −7 −2 |
| −31% | −21 −7 −2 −1 |

These in-line, buck/boost, voltage-regulation systems and apparatus can be used for efficiently controlling voltages for regulating brightness of illumination of lighting systems in large high-ceiling stores having numerous windows for admitting daylight. The lighting systems often require full voltage for turning on the lights, then, their voltages often are lowered for reducing intensity of lighting illumination as the brightness of incoming daylight increases, and vice versa.

Since other changes and modifications varied to fit particular single-phase and three-phase AC voltage-regulation requirements and environments will be recognized by those skilled in the art, the invention is not considered limited to the examples chosen for purposes of illustration, and includes all changes and modifications which do not constitute a departure from the true spirit and scope of this invention as claimed in the following claims and equivalents thereto.

We claim:

1. Apparatus for in-line regulation of an alternating current voltage for delivering AC electrical power at a regulated voltage level from an output terminal to an electrical load and wherein the apparatus has an input terminal for connection to an AC supply of electrical power, said apparatus comprising:

at least first, second and third ferromagnetic transformer cores having first, second and third cross-sectional areas, respectively;

said first, second and third cross-sectional areas having differing relative sizes of X square units, Y square units and Z square units, respectively;

first, second and third regulator windings on said first, second and third cores, respectively;

said first regulator winding electromagnetically coupling only with said first core;

said second regulator winding electromagnetically coupling only with said second core;

said third regulator winding electromagnetically coupling only with said third core;

said first, second and third regulator windings having first, second and third numbers of turns, respectively;

said first, second and third numbers having relative values of N1, N2 and N3, where N1, N2 and N3 are predetermined different numbers of turns of regulator windings;

switching means for selectively connecting said first, second and/or third regulator windings across the AC supply and for selectively short-circuiting any of said first, second and/or third regulator windings which are not connected across the AC supply;

a main winding on said first, second and third cores;

said main winding electromagnetically coupling with all of said first, second and third cores;

said main winding having said input terminal for connection to the AC supply of electrical power; and said main winding having said output terminal for delivering AC power of regulated voltage from said output terminal to an electrical load.

2. Apparatus as claimed in claim 1, in which:

said switching means includes first, second and third resistance means, respectively;

said first, second and third electrical resistance means being momentarily connected in circuit across said first, second and third regulator windings, respectively, during selective switching of the first, second and third regulator windings, respectively, from being short-circuited to being connected across the AC supply; and said first, second and third resistance means also being momentarily connected in circuit across said first, second and third regulator windings, respectively, during selective switching of the first, second and third regulator windings, respectively, from being connected across the AC supply to being short-circuited.

3. Apparatus as claimed in claim 1, further comprising:

first, second and third transition-current-flow-path means providing respective transition-current-flow paths for said first, second and third regulator windings, respectively, during selective switching of the respective first, second and third regulator windings from being short-circuited to being connected across the AC supply; and also providing respective transition-current-flow paths for said first, second and third regulator windings, respectively, during selective switching of the respective first, second and third regulator windings from being connected across the AC supply to being short-circuited.

4. Apparatus as claimed in claim 3, in which:

said first, second and third transition-current-flow-path means each include respective electrical resistance means.

5. Apparatus as claimed in claim 1, in which:

said switching means selectively connect the first, second and/or third regulator windings across the AC supply in voltage bucking mode or voltage boosting mode in relation to the main winding for reducing or increasing voltage delivered at said output terminal of the main winding relative to voltage applied to the input terminal of the main winding.

6. Apparatus as claimed in claim 1, in which:

said first, second and third cores all have the same height and width and also all have winding windows of the same height and width, and said first, second and third cores have different thicknesses for providing said differing relative sizes of cross-sectional areas.

7. Apparatus as claimed in claim 1, in which:

said cross-sectional areas of X square units, Y square units and Z square units have relative sizes of substantially 1 to 2 to 4.

8. Apparatus as claimed in claim 5, in which:

said cross-sectional areas of X square units, Y square units and Z square units have relative sizes of substantially 1 to 2 to 7.

9. Apparatus as claimed in claim 1, in which:

said first, second and third cores are three-phase cores for an AC supply having A, B and C phases, said first, second and third regulator windings each comprise three windings for the A, B and C phases, respectively, and said main winding comprises three windings for the A, B and C phases, respectively.

10. Apparatus as claimed in claim 1, further including a fourth ferromagnetic transformer core, and the first, second, third and fourth cores have respective cross-sectional areas which have relative sizes in a ratio of substantially 1 to 2 to 4 to 8.

11. Apparatus as claimed in claim 5, further including a fourth ferromagnetic transformer core, and the first, second, third and fourth cores have respective cross-sectional areas which have relative sizes in a ratio of substantially 1 to 2 to 7 to 21.

12. Apparatus as claimed in claim 1, further including fourth and fifth ferromagnetic transformer cores and the first, second, third, fourth and fifth cores have respective cross-sectional areas have relative sizes in a ratio of substantially 1 to 2 to 4 to 8 to 16.

13. Apparatus as claimed in claim 1 further comprising:

control means responsive to zero-axis crossings of voltages at respective switching means for selectively actuating the respective switching means during instants when zero-axis crossings of voltages are occurring at the respective switching means.

14. An in-line voltage-regulation transformer comprising:

a main winding having an input terminal for connection in circuit with an AC source of electrical power and having an output terminal for connection in circuit with an electrical load for positioning said main winding in circuit in-line between said AC source and said electrical load;

at least first, second and third ferromagnetic transformer cores;

said first, second and third cores having first, second and third cross-sectional areas;

said first, second and third cross-sectional areas being progressively relatively larger in size;

said main winding being electromagnetically coupled to all of said first, second and third cores;

first, second and third regulator windings being electromagnetically individually coupled essentially solely to said first, second and third cores, respectively;

said first, second and third regulator windings having first, second and third numbers of turns, respectively;

said first, second and third numbers of turns of regulator windings being progressively smaller; and said first, second and third numbers of turns being substantially inversely proportional to relative sizes of said first, second and third cross-sectional areas.

15. An in-line voltage-regulation transformer as claimed in claim 14, wherein:

said first, second and third cross-sectional areas are relatively sized in a ratio substantially of 1 to 2 to 4.

16. An in-line voltage-regulation transformer as claimed in claim 14, wherein:

further including a fourth ferromagnetic transformer core;

said first, second, third and fourth cores have first, second, third and fourth cross-sectional areas;

said first, second, third and fourth cross-sectional areas are progressively relative larger in size;

said main winding is coupled to all of said first, second, third and fourth cores;

further including a fourth regulator winding;

said first, second, third and fourth regulator windings are electromagnetically individually coupled essentially solely to said first, second, third and fourth cores, respectively;

said first, second, third and fourth regulator windings have first, second, third and fourth numbers of turns, respectively;

said first, second, third and fourth numbers of turns are progressively smaller; and said first, second, third and fourth numbers of turns are substantially inversely proportional to relative sizes of said first, second, third and fourth cross-sectional areas.

17. A transformer for alternating current comprising at least first, second and third ferromagnetic transformer cores;

said transformer cores having substantially the same heights and widths;

said first, second and third transformer cores having progressively greater thicknesses;

said first, second and third transformer cores having first, second and third winding windows, respectively;

said windows having substantially the same heights and widths;

said first, second and third transformer cores being positioned in aligned spaced parallel relationship with said windows being aligned with each other;

a main winding having a plurality of turns passing through said first, second and third windows and passing around portions of all of said cores;

first, second and third regulator windings;

said first regulator winding having a first number of turns passing through said first window and passing around a portion of said first core;

said second regulator winding having a second number of turns passing through said second window and passing around a portion of said second core; and said third regulator winding having a third number of turns passing through said third window and passing around a portion of said third core.

18. A transformer as claimed in claim 17, wherein:

said first, second and third numbers of turns are progressively smaller.

19. A transformer as claimed in claim 18, wherein:

said first, second and third numbers of turns are substantially inversely proportional to relative thicknesses of said first, second and third cores.

20. A three-phase transformer for three-phase alternating current comprising:

at least first, second and third ferromagnetic transformer cores;

said transformer cores having substantially the same heights and widths;

said first, second and third transformer cores being progressively greater in relative thickness;

said first, second and third transformer cores having a pair of first, a pair of second and a pair of third winding windows, respectively;

said windows having substantially the same heights and widths;

said first, second and third transformer cores being positioned in aligned spaced parallel relationship with said pair of first windows being aligned with said pair of second windows being aligned with said pair of third windows;

an "A" phase main winding having a number of turns;

said "A" phase main winding passing through at least one of each of said first, second and third windows and passing around portions of said first, second and third cores and being electromagnetically coupled to said first, second and third cores;

a "B" phase main winding having a number of turns equal to the number of turns in said "A" phase main winding;

said "B" phase main winding passing through at least one of each of said first, second and third windows and passing around portions of said first, second and third cores and being electromagnetically coupled to said first, second and third cores;

a "C" phase main winding having a number of turns equal to the number of turns in said "A" phase main winding and also equal to the number of turns in said "B" phase main winding;

said "C" phase main winding passing through at least one of each of said first, second and third windows and passing around portions of said first, second and third cores and being electromagnetically coupled to said first, second and third cores;

first, second and third "A" phase regulator windings having first, second and third numbers of turns, respectively;

said first, second and third numbers of turns of said "A" phase regulator windings having relative values of N1, N2 and N3, respectively;

first, second and third "B" phase regulator windings having first, second and third numbers of turns, respectively;

said first, second and third numbers of turns of said "B" phase regulator windings having relative values of N1, N2 and N3, respectively;

first, second and third "C" phase regulator windings having first, second and third numbers of turns, respectively;

said first, second and third numbers of turns of said "C" phase regulator windings having relative values of N1, N2 and N3, respectively;

said first, second and third "A" phase regulator windings passing respectively through a first, a second and a third window and passing respectively around portions of said first, second and third cores and electromagnetically individually coupling essentially solely to said first, second and third cores, respectively;

said first, second and third "B" phase regulator windings passing respectively through a first, a second and a third window and passing respectively around portions of said first, second and third cores and electromagnetically individually coupling essentially solely to said first, second and third cores, respectively;

said first, second and third "C" phase regulator windings passing respectively through a first, a second and a third window and passing respectively around portions of said first, second and third cores and electromagnetically individually coupling essentially solely to said first, second and third cores, respectively; and

N1, N2 and N3 being substantially inversely proportional to the relative thicknesses of said first, second and third cores.

* * * * *